US008609316B2

(12) United States Patent
Hara et al.

(10) Patent No.: US 8,609,316 B2
(45) Date of Patent: Dec. 17, 2013

(54) METHOD FOR MANUFACTURING CAPSULE TONER

(75) Inventors: Takashi Hara, Osaka (JP); Yoshiaki Akazawa, Osaka (JP); Yoshitaka Kawase, Osaka (JP); Yoritaka Tsubaki, Osaka (JP); Yoshinori Mutoh, Osaka (JP); Keiichi Kikawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 321 days.

(21) Appl. No.: 12/986,790

(22) Filed: Jan. 7, 2011

(65) Prior Publication Data

US 2011/0171574 A1 Jul. 14, 2011

(30) Foreign Application Priority Data

Jan. 8, 2010 (JP) ..... P2010-003296

(51) Int. Cl.
*G03G 9/093* (2006.01)

(52) U.S. Cl.
USPC ..... 430/137.11; 430/110.2

(58) Field of Classification Search
USPC ..... 430/137.11, 110.2
See application file for complete search history.

(56) References Cited

U.S. PATENT DOCUMENTS

| | | | | |
|---|---|---|---|---|
| 3,893,932 | A | 7/1975 | Azar et al. | |
| 4,915,987 | A | 4/1990 | Nara et al. | |
| 5,296,266 | A | 3/1994 | Kunugi et al. | |
| 5,574,174 | A | 11/1996 | Syed | |
| 5,976,755 | A | 11/1999 | Yoshida et al. | |
| 6,686,112 | B2 | 2/2004 | Teshima et al. | |
| 7,247,413 | B2 * | 7/2007 | Kido et al. | 430/110.2 |
| 7,932,010 | B2 | 4/2011 | Yamada et al. | |
| 8,197,999 | B2 | 6/2012 | Kawase et al. | |
| 2001/0033982 | A1 | 10/2001 | Ishikawa et al. | |
| 2005/0074685 | A1 | 4/2005 | Kido et al. | |
| 2006/0014094 | A1 * | 1/2006 | Yuasa et al. | 430/108.2 |
| 2007/0065744 | A1 | 3/2007 | Ishikawa et al. | |
| 2008/0166156 | A1 | 7/2008 | Kawase | |
| 2009/0246672 | A1 | 10/2009 | Ishikawa et al. | |
| 2009/0297224 | A1 * | 12/2009 | Kawase et al. | 399/252 |
| 2010/0015544 | A1 | 1/2010 | Agur et al. | |

FOREIGN PATENT DOCUMENTS

| | | |
|---|---|---|
| CN | 101376738 A | 3/2009 |
| JP | 4-211269 | 8/1992 |
| JP | 4-311965 | 11/1992 |
| JP | 5-10971 | 2/1993 |
| JP | 11-015206 | 1/1999 |
| JP | 2001-235894 | 8/2001 |
| JP | 2001-324831 | 11/2001 |
| JP | 3372698 | 2/2003 |
| JP | 2005-024784 | 1/2005 |
| JP | 2005-99079 | 4/2005 |
| JP | 2005-99085 | 4/2005 |
| JP | 2005-266565 | 9/2005 |
| JP | 2006-91379 | 4/2006 |
| JP | 2006-113473 | 4/2006 |
| JP | 2007-003840 | 1/2007 |
| JP | 2007-057823 | 3/2007 |
| JP | 2008-015232 | 1/2008 |
| JP | 2008-191639 | 8/2008 |
| JP | 2009-014757 | 1/2009 |

* cited by examiner

*Primary Examiner* — Janis L Dote
(74) *Attorney, Agent, or Firm* — Nixon Vanderhye P.C.

(57) ABSTRACT

A method for manufacturing a capsule toner having improved preservability with no deterioration in low-temperature fixability is provided. The method for manufacturing a capsule toner includes a mixed fine resin particle adhering step of adhering mixed fine resin particles including crystalline polyester fine resin particles and amorphous fine resin particles to surfaces of toner base particles to form mixed fine resin particle-adhered particles, a spraying step of spraying a mixed solution of a liquid for plasticizing the toner base particles and the mixed fine resin particles and a crystal nucleating agent, while fluidizing the mixed fine resin particle-adhered particles, and a film-forming step of making a film of the mixed fine resin particles by impact force so that the film is a resin coating layer on the surfaces of the toner base particles.

4 Claims, 4 Drawing Sheets

METHOD FOR MANUFACTURING CAPSULE TONER

CROSS-REFERENCE TO RELATED APPLICATION

This application claims priority to Japanese Patent Application No. 2010-003296, which was filed on Jan. 8, 2010, the contents of which are incorporated herein by reference in its entirety.

BACKGROUND OF THE INVENTION

1. Field of the Invention

The present invention relates to a method for manufacturing a capsule toner.

2. Description of the Related Art

In electrophotographic image forming apparatuses, a surface of an image bearing member is uniformly charged by a charging section (charging step), and this surface of the image bearing member is exposed by an exposure section and the charge of the exposed part is dissipated to form an electrostatic latent image (exposure step). Then, a toner which is a colored fine powder having a charge is adhered to the electrostatic latent image to make the image visible (developing step) and the obtained visible image is transferred to a recording medium such as paper (transfer step). Further, the visible image is fixed on a recording medium by applying heat and/or pressure, or other fixing methods by means of a fixing section (fixing step). By performing the steps as described above, an image is formed on the recording medium. Further, cleaning of the image bearing member is carried out in order to remove the toner which is not transferred to a recording medium and remains on the surface of the image bearing member (cleaning step).

It is necessary that the toner used for formation of these images be provided with functions required in each of a transfer step, a fixing step, and a cleaning step as well as a developing step.

Examples of the method for fixing a toner include a heat-fixing method, in which a toner is melted by applying heat and fixed on a recording medium, and a pressure-fixing method, in which a toner is plastically deformed through application of pressure to be fixed on a recording medium.

For the heat-fixing method, in consideration of the convenience of the fixing device, image quality after fixing, or the like, a heat-roll fixing method in which a heat roll is used as a heating medium for melting a toner by applying heat is often used. In this method, from the viewpoint of energy-saving, it is necessary to melt the toner at the lowest temperature possible, thereby making the toner fix on a recording medium. In this regard, low-temperature fixability of the toner is required, and reduction in the softening temperature of the toner is carried out, for example, by decreasing the molecular weight of a binder resin contained in the toner or by adding a release agent to the toner.

However, such a toner has problems of reduction in preservability since although the toner has low-temperature fixability, it is easily softened and aggregated by heat under a high temperature environment, for example, when left in a car in hot weather.

In order to solve these problems, Japanese Unexamined Patent Publication JP-A 2005-266565 discloses a toner having a core/shell structure, which contains a crystalline polyester resin in a core and an amorphous polymeric resin as a main component in a shell layer.

However, for a toner disclosed in JP-A 2005-266565, a core containing a crystalline polyester resin is covered with a shell layer including an amorphous polymeric resin, and thus, although preservability is secured, there is a problem that the low-temperature fixability of the crystalline polyester resin is deteriorated, and accordingly, both of the low-temperature fixability and the preservability are not improved together.

SUMMARY OF THE INVENTION

Therefore, an object of the invention is to provide a method for manufacturing a capsule toner having improved preservability without deterioration of low-temperature fixability.

The invention provides a method for manufacturing a capsule toner, comprising:

a mixed fine resin particle adhering step of adhering mixed fine resin particles including crystalline polyester fine resin particles and amorphous fine resin particles to surfaces of toner base particles to form mixed fine resin particle-adhered particles;

a spraying step of spraying a mixed solution of a liquid for plasticizing the toner base particles and the mixed fine resin particles and a crystal nucleating agent, while fluidizing the mixed fine resin particles-adhered particles; and a film-forming step of making a film of the mixed fine resin particles by impact force so that the film is a resin coating layer on the surfaces of the toner base particles.

According to the invention, since the mixed fine resin particle-adhered particles formed by adhering the mixed fine resin particles including the crystalline polyester fine resin particles and the amorphous fine resin particles on surfaces of the toner base particles are sprayed with a mixed solution of a liquid for plasticizing the toner base particles and the mixed fine resin particles and a crystal nucleating agent, crystallization of the crystalline polyester fine resin particles is promoted. As a result, reduction in preservation stability of the capsule toner by the crystalline polyester resin can be prevented, and even when mixed fine resin particles are, melt-deformed by impact force, immediate recrystallization can be performed so as to prevent occurrence of aggregation, and film formation of the mixed fine resin particles can be suitably promoted. Simultaneously, an effect of lowering the fixing initiation temperature with a crystalline polyester resin and an effect of improving the preservation stability with an amorphous resin can be obtained.

Furthermore, by spraying the mixed solution on the mixed fine resin particle-adhered particles, the toner base particles and the mixed fine resin particles are plasticized and softened, and thus, a resin coating layer can be formed on the surfaces of the toner base particles by little impact force. Further, since vaporization heat is lost during the evaporation of the sprayed liquid, film formation can be carried out at a low temperature, and the effect of the crystalline polyester resin can be attained to the largest extent.

Moreover, in the invention, it is preferable that the crystal nucleating agent is a sorbitol-based compound.

According to the invention, since the crystal nucleating agent is a sorbitol-based compound, a function for promoting the crystallization of the crystalline polyester fine resin particles can be exerted effectively. Further, since the sorbitol-based compound has low colorability, suitable colorability can be obtained even in the case of a color toner.

Furthermore, the invention provides a method for manufacturing a capsule toner, comprising:

a mixed fine resin particle adhering step of adhering mixed fine resin particles including crystalline polyester fine resin particles and amorphous fine resin particles to surfaces of toner base particles including a crystal nucleating agent to form mixed fine resin particle-adhered particles;

a spraying step of spraying a liquid for plasticizing the toner base particle and the mixed fine resin particles, while fluidizing the mixed fine resin particle-adhered particles; and a film-forming step of making a film of the mixed fine resin particles by impact force so that the film is a resin coating layer on the surfaces of the toner base particles.

According to the invention, since the toner base particles contain a crystal nucleating agent, crystallization of the mixed fine resin particles including the crystalline polyester fine resin particles and the amorphous fine resin particles adhered to the surfaces of the toner base particles is promoted. As a result, reduction in preservation stability of the capsule toner by the crystalline polyester resin can be prevented, and occurrence of aggregation can be prevented by performing recrystallization even when the mixed fine resin particles are melt-deformed by impact force, and the film formation of the mixed fine resin particles can be suitably promoted. Simultaneously, an effect of lowering the fixing initiation temperature by a crystalline polyester resin and an effect of improving the preservation stability of an amorphous resin can be obtained.

Further, in the invention, it is preferable that the crystal nucleating agent is a fatty acid amide or a sorbitol-based compound.

According to the invention, since the crystal nucleating agent is a fatty acid amide or a sorbitol-based compound, a function for promoting the crystallization of the crystalline polyester fine resin particles can be exerted effectively. Further, since the fatty acid amide or the sorbitol-based compound has low colorability, suitable colorability can be obtained even in the case of a color toner.

Furthermore, the invention provides a method for manufacturing a capsule toner, comprising:

a mixed fine resin particle adhering step of adhering mixed fine resin particles including crystalline polyester fine resin particles, amorphous fine resin particles, and a crystal nucleating agent to surfaces of toner base particles to form mixed fine resin particle-adhered particles;

a spraying step of spraying a liquid for plasticizing the toner base particles and the mixed fine resin particles, while fluidizing the mixed fine resin particle-adhered particles; and a film-forming step of making a film of the mixed fine resin particles by impact force so that the film is a resin coating layer on the surfaces of the toner base particles.

According to the invention, since the mixed fine resin particles including crystalline polyester fine resin particles and amorphous fine resin particles include a crystal nucleating agent, the crystallization of the crystalline polyester fine resin particles is promoted. As a result, reduction in preservation stability of the capsule toner by the crystalline polyester resin can be prevented, and the occurrence of aggregation can be prevented by performing recrystallization even when the mixed fine resin particles are melt-deformed by impact force, and the film formation of the mixed fine resin particles can be suitably promoted. Simultaneously, an effect of reduction in the fixing initiation temperature by a crystalline polyester resin and an effect of improvement of the preservation stability of an amorphous resin can be obtained.

In addition, by allowing the mixed fine resin particles including crystalline polyester fine resin particles containing a crystal nucleating agent and amorphous fine resin particles to be sprayed with a liquid for plasticizing the toner base particles and the mixed fine resin particles, the toner base particles and the mixed fine resin particles are plasticized and softened, and therefore, a resin coating layer can be formed on the surfaces of the toner base particles with little impact force. Further, since vaporization heat is lost during evaporation of the sprayed liquid, film formation can be carried out at a low temperature and the effect of the crystalline polyester resin can be attained to the largest extent.

Further, in the invention, it is preferable that the crystal nucleating agent is a fatty acid amide or a sorbitol-based compound.

According to the invention, since the crystal nucleating agent is a fatty acid amide or a sorbitol-based compound, a function for promoting the crystallization of the crystalline polyester can be exerted effectively. Further, since the fatty acid amide or the sorbitol-based compound has low colorability, suitable colorability can be obtained even in the case of a color toner.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
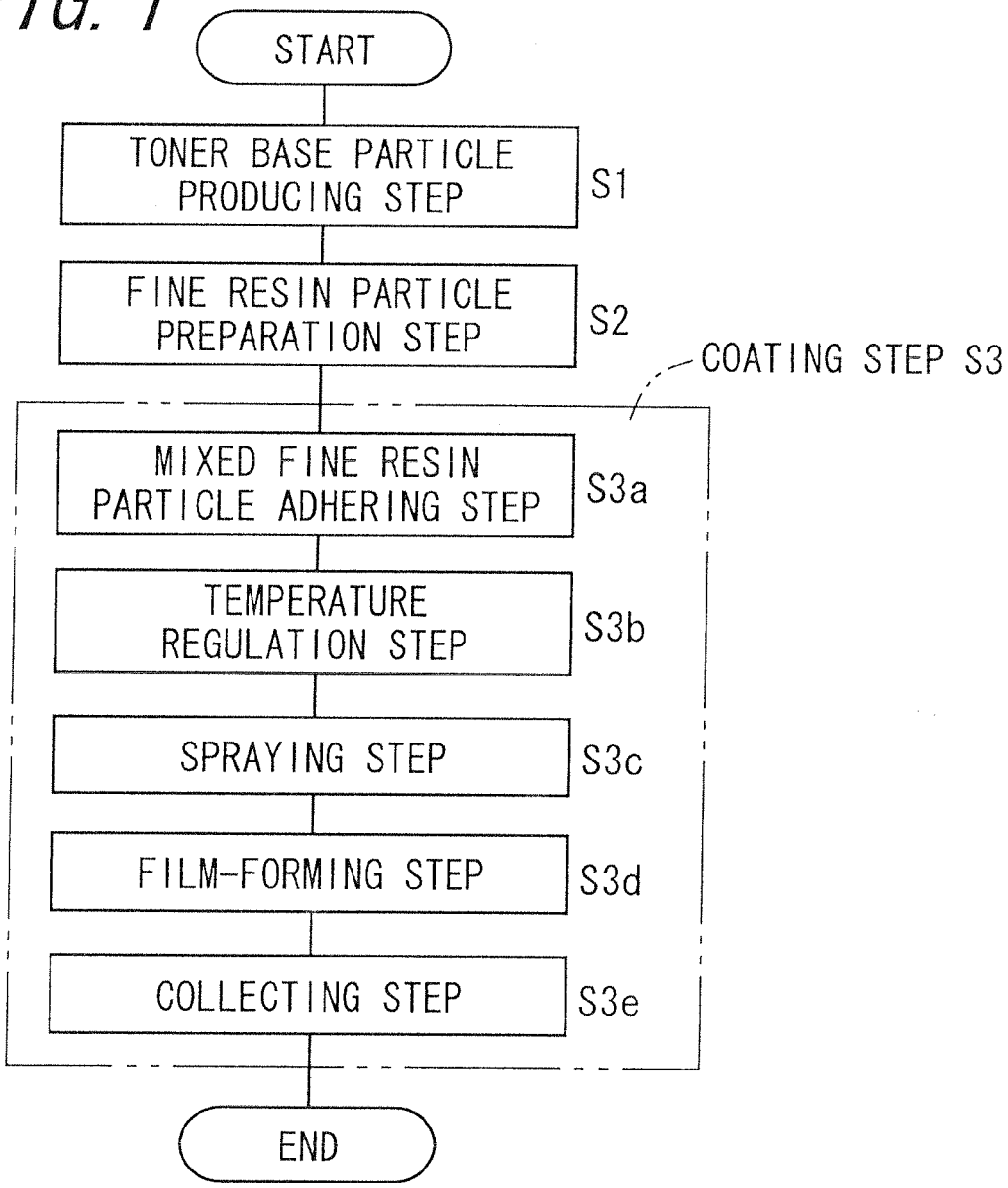
FIG. 1 is a flowchart of an example of a procedure for the method for manufacturing a capsule toner of the invention.

Now referring to the drawings, preferred embodiments of the invention are described below.

1. Method for Manufacturing Toner

FIG. 1 is a flowchart of an example of a procedure for the method for manufacturing a capsule toner of the invention. The method for manufacturing a capsule toner of the invention includes a toner base particle producing step S1 of producing toner base particles, a fine resin particle preparation step S2 of preparing fine resin particles including crystalline polyester fine resin particles and amorphous fine resin particles, and a coating step S3 of coating the toner base particles with fine resin particles.

The capsule toner obtained by the method for manufacturing a capsule toner of the invention is one in which a resin coating layer including a crystalline polyester resin and an amorphous resin is formed on the surfaces of the toner base particles. Further, in the method for manufacturing a capsule toner of the invention, by incorporating a crystalline polyester fine resin particle surface in the crystalline polyester fine resin particles, or incorporating a crystal nucleating agent in the toner base particles, the crystallization of the crystalline polyester fine resin particles is promoted, and thus, a capsule toner in which a resin coating layer is formed on the surfaces of the toner base particles is obtained.

It is preferable that the crystal nucleating agent has a crystal structure close to a crystalline polyester resin and it is also preferable that the crystal nucleating agent be finely dispersed in the crystalline polyester resin, so that the crystal nucleating agent may exert effectively a function of promoting the crystallization of the crystalline polyester fine particles. As such a crystal nucleating agent, a crystal nucleating agent having a higher melting point than that of the crystalline polyester resin and a crystal nucleating agent in which a raw material monomer of the crystalline polyester resin exhibits a certain level or higher of solubility in at least one kind are preferred. Since the crystal nucleating agent having a higher melting point than that of the crystalline polyester resin is crystallized more quickly than the crystalline polyester resin, it serves as a crystal nucleating agent effectively. In addition, a crystal nucleating agent in which a raw material monomer of the crystalline polyester resin exhibits a certain level or higher of solubility in at least one kind is easily dispersed in the crystalline polyester resin finely and has an increased effect of promotion of crystallization.

Examples of the crystal nucleating agent provided with such properties include a fatty acid amide and a sorbitol-based compound.

As the fatty acid amide, an alkylene bisfatty acid amide is preferable from the viewpoint of compatibility with a polyester. The alkylene group preferably has 2 to 8 carbon atoms, and more preferably 2 to 6 carbon atoms. Further, the fatty acid group preferably has 6 to 30 carbon atoms, and more preferably 8 to 24 carbon atoms.

Examples of the fatty acid amide that is suitable in the invention include ethylene bisstearic acid amide, hexamethylene bislauric acid amide, ethylene bislauric acid amide, and hexamethylene bisstearic acid amide, and from the viewpoint of the degree of crystallinity, ethylene bisstearic acid amide is more preferable.

Examples of the sorbitol-based compound include dibenzylidene sorbitol, bis(p-methylbenzylidene)sorbitol, bis(p-ethylbenzylidene)sorbitol, and bis(3,4-dimethylbenzylidene)sorbitol, and from the viewpoint of the compatibility with a crystalline polyester, bis(p-methylbenzylidene)sorbitol is preferable.

The additive amount of the crystal nucleating agent is preferably from 0.2% by weight to 7% by weight, and more preferably from 0.4% by weight to 5% by weight, based on the toner base particle when it is included in the toner base particles. If the additive amount of the crystal nucleating agent is less than 0.2% by weight, a sufficient effect of promotion of the crystallization for the crystalline polyester fine resin particles cannot be obtained, and if the additive amount is more than 7% by weight, the resin concentration in the toner base particles cannot be maintained at a high value, and thus, the fixability is reduced.

Furthermore, the additive amount of the crystal nucleating agent is preferably about from 0.1% by weight to 20% by weight based on the crystalline polyester fine resin particles when the crystal nucleating agent is included in the crystalline polyester fine resin particles or around the crystalline polyester fine resin particles surface, and within this range, it promotes the crystallization without deterioration of the function of the crystalline polyester resin.

(1) Toner Base Particle Producing Step S1

In the toner base particle producing step S1, toner base particles to be coated with a resin coating layer are produced. The toner base particles are particles each containing a binder resin and a colorant, and a method for producing the same is not particularly limited, but it can be carried out according to a known method. Examples of the method for producing the toner base particles include dry methods such as a pulverization method, and wet methods such as a suspension polymerization method, an emulsion aggregation method, a dispersion polymerization method, a dissolution suspension method, or a melting emulsion method. The method for producing the toner base particles according to the pulverization method will be described below.

(Method for Producing Toner Base Particles by Pulverization Method)

In a method for producing toner base particles by a pulverization method, a toner composition containing a binder resin, a colorant, and other additives is dry-mixed by a mixer, and then melt-kneaded by a kneader. The kneaded material obtained by melt-kneading is cooled and solidified, and then the solidified material is pulverized by a pulverizer. Subsequently, the toner base particles are obtained, if needed, by conducting adjustment of a particle size such as classification.

As the mixer, a known mixer can be used, and examples thereof include Henschel-type mixers such as HENSCHEL MIXER (trade name, manufactured by Mitsui Mining Co., Ltd.), SUPERMIXER (trade name, manufactured by Kawata MEG Co., Ltd.), MECHANOMILL (trade name, manufactured by Okada Seiko Co., Ltd.), ANGMILL (trade name, manufactured by Hosokawa Micron Corporation), HYBRIDIZATION SYSTEM (trade name, manufactured by Nara Machinery Co., Ltd.), and COSMOSYSTEM (trade name, manufactured by Kawasaki Heavy Industries, Ltd.)

As the kneader, a known kneader can be used, and for example, commonly-used kneaders such as a twin-screw extruder, a three-roll mill, a laboplast mill, and the like can be used. Specific examples of such a kneader include single or twin screw extruders such as TEM-100B (trade name, manufactured by Toshiba Machine Co., Ltd.), PCM-65/87 and PCM-30 (both trade names, manufactured by Ikegai, Ltd.), and open roll-type kneaders such as KNEADEX (trade name, manufactured by Mitsui Mining Co., Ltd). Among them, the open roll-type kneaders are preferable.

Examples of the pulverizer include a jet pulverizer which performs pulverization using an ultrasonic jet air stream, and an impact pulverizer which performs pulverization by guiding a solidified material to a space formed between a rotator that is rotated at high speed (rotor) and a stator (liner).

For the classification, a known classifier that is capable of removing excessively pulverized toner base particles by classification with a centrifugal force or a wind force can be used, and examples thereof include a revolving type wind-force classifier (rotary type wind-force classifier).

As described above, the toner base particles contain the binder resin and the colorant. The binder resin is not particularly limited and any known binder resin used for a black toner or a color toner can be used, and examples thereof include styrene-based resins such as a polystyrene, or a styrene-acrylate copolymer resin; acryl-based resins such as a polymethyl methacrylate; polyolefin-based resins such as polyethylene; polyester resins; polyurethane; and epoxy resins. Further, a resin obtained by mixing a raw material monomer mixture with a release agent, and performing a polymerization reaction may be used. The binder resins may be used each alone, or two or more of them may be used in combination.

Among the binder resins as described above, the polyester resin is preferable as a binder resin for a color toner due to its excellent transparency as well as good powder flowability, low-temperature fixability, secondary color reproductively, and the like to be provided for the toner particles. For the polyester resin, known substances may be used and examples thereof include a polycondensate of a polybasic acid and a polyvalent alcohol.

For the polybasic acid, substances known as monomers for a polyester resin can be used including, for example: aromatic carboxylic acids such as terephthalic acid, isophthalic acid, phthalic anhydride, trimellitic anhydride, pyromellitic acid, or naphthalene dicarboxylic acid; aliphatic carboxylic acids such as maleic anhydride, fumaric acid, succinic acid, alkenyl succinic anhydride, or adipic acid; and methyl-esterified compounds of these polybasic acids. The polybasic acids may be used each alone, or two or more of them may be used in combination.

For the polyvalent alcohol, substances known as monomers for a polyester resin can also be used including, for example: aliphatic polyvalent alcohols such as ethylene glycol, propylene glycol, butenediol, hexanediol, neopentyl glycol, or glycerin; alicyclic polyvalent alcohols such as cyclohexanediol, cyclohexanedimethanol, or hydrogenated bisphenol A; aromatic diols such as ethylene oxide adduct of bisphenol A, or propylene oxide adduct of bisphenol A; etc. The polyvalent alcohols may be used each alone, or two or more of them may be used in combination.

The polybasic acid and the polyvalent alcohol can undergo a polycondensation reaction in an ordinary manner, that is, for example, the polybasic acid and the polyvalent alcohol are brought into contact with each other in the presence or absence of an organic solvent and in the presence of a polycondensation catalyst, and this polycondensation reaction ends when an acid number, a softening temperature, or the like of the resulting polyester resin reaches predetermined values. The polyester resin can be thus obtained.

When the methyl-esterified compound of the polybasic acid is used as a part of the polybasic acid, a dimethanol polycondensation reaction is caused. In this polycondensation reaction, a compounding ratio, a reaction rate, and the like of the polybasic acid and the polyvalent alcohol are appropriately modified, thereby allowing capability of, for example, adjusting the content of a carboxyl group at a terminal in the polyester resin, and further allowing for plastic deformation of the obtained polyester resin. Further, a denatured polyester resin can be obtained also by simply introducing a carboxyl group to a main chain of the polyester resin with use of trimellitic anhydride as a polybasic acid. A polyester resin having self-dispersibility in water may also be used, in which a hydrophilic group such as a carboxyl group, or a sulfonic acid group is bonded to a main chain and/or a side chain of the polyester resin. Further, a polyester resin may be grafted with an acrylic resin.

It is preferred that the binder resin has a glass transition temperature of from 30° C. to 80° C. When the glass transition temperature of the binder resin is lower than 30° C., the blocking in which the toner thermally aggregates inside the image forming apparatus is easily caused, which may decrease preservation stability. When the glass transition temperature of the binder resin exceeds 80° C., the fixability of the toner onto a recording medium is lowered, which may cause a fixing failure.

As the colorant, it is possible to use an organic dye, an organic pigment, an inorganic dye, an inorganic pigment, or the like, which is commonly used in the electrophotographic field.

Examples of a black colorant include carbon black, copper oxide, manganese dioxide, aniline black, activated carbon, non-magnetic ferrite, magnetic ferrite, and magnetite.

Examples of a yellow colorant include chrome yellow, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C. I. Pigment Yellow 12, C. I. Pigment Yellow 13, C. I. Pigment Yellow 14, C. I. Pigment Yellow 15, C. I. Pigment Yellow 17, Pigment Yellow 74, C. I. Pigment Yellow 93, C. I. Pigment Yellow 94, C. I. Pigment Yellow 138, C. I. Pigment Yellow 180, and C. I. Pigment Yellow 185.

Examples of an orange colorant include red chrome yellow, molybdenum orange, permanent orange GTR, pyrazolone orange, vulcan orange, indanthrene brilliant orange RK, benzidine orange G, indanthrene brilliant orange GK, C. I. Pigment Orange 31, and C. I. Pigment Orange 43.

Examples of a red colorant include red iron oxide, cadmium red, red lead, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, and C. I. Pigment Red 222.

Examples of a purple colorant include manganese purple, fast violet B, and methyl violet lake.

Examples of a blue colorant include Prussian blue, cobalt blue, alkali blue lake, Victoria blue lake, phthalocyanine blue, metal-free phthalocyanine blue, phthalocyanine blue-partial chlorination product, fast sky blue, indanthrene blue BC, C. I. Pigment Blue 15, C. I. Pigment Blue 15:2, C. I. Pigment Blue 15:3, C. I. Pigment Blue 16, and C. I. Pigment Blue 60.

Examples of a green colorant include chromium green, chromium oxide, Pigment Green B, malachite green lake, final yellow green G, and C. I. Pigment Green 7.

Examples of a white colorant include those compounds such as zinc oxide, titanium oxide, and antimony white, zinc sulfide.

The colorants may be used each alone, or two or more of the colorants of different colors may be used in combination. Further, two or more of the colorants with the same color may be used in combination. The usage of the colorant is not particularly limited, but it is preferably from 5 parts by weight to 20 parts by weight, and more preferably from 5 parts by weight to 10 parts by weight, based on 100 parts by weight of the binder resin.

The colorant may be used as a masterbatch to be dispersed uniformly in the binder resin. Further, two or more of the colorants may be formed into a composite particle. The composite particle is capable of being manufactured, for example, by adding an appropriate amount of water, lower alcohol, and the like to two or more of colorants and granulating them by a general granulating machine such as a high-speed mill, followed by drying. The masterbatch and the composite particle are incorporated into the toner composition at the time of dry-mixing.

The toner base particles may contain a charge control agent in addition to the binder resin and the colorant. For the charge control agent, charge control agents commonly used in this field for controlling a positive charge and a negative charge can be used.

Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye and a derivative thereof, a triphenylmethane derivative, a guanidine salt, and an amidine salt.

Examples of the charge control agent for controlling a negative charge include an oil-soluble dye such as an oil black and a spirone black, a metal-containing an azo compound, an azo complex dye, a naphthene acid metal salt, a metal complex or metal salt (the metal is chrome, zinc, zirconium, or the like) of a salicylic acid and of a derivative thereof, a boron compound, a fatty acid soap, a long-chain alkyl carboxylic acid salt, and a resin acid soap. The charge control agents may be used each alone, or two or more of them may be used in combination if needed. Although the usage of the charge control agent is not particularly limited and can be properly selected from a wide range, the amount is preferably from 0.5 part by weight to 3 parts by weight based on 100 parts by weight of the binder resin.

Furthermore, the toner base particles may contain a release agent in addition to the binder resin and the colorant. As the release agent, it is possible to use ingredients which are commonly used in this field, including, for example, petroleum wax such as paraffin wax and a derivative thereof, or microcrystalline wax and a derivative thereof; hydrocarbon-based synthetic wax such as Fischer-Tropsch wax and a derivatives thereof, polyolefin wax (polyethylene wax, polypropylene wax, or the like) and a derivative thereof, low-molecular-weight polypropylene wax and a derivative thereof, or polyolefinic polymer wax (low-molecular-weight polyethylene wax, or the like) and a derivative thereof; vegetable wax such as carnauba wax and a derivative thereof, rice wax and a derivative thereof, candelilla wax and a derivative thereof, or Japan wax; animal wax such as bees wax or spermaceti wax; fat and oil-based synthetic wax such as fatty acid amides or phenolic fatty acid esters; long-chain carboxylic acids and a derivative thereof; long-chain alcohols and a derivative thereof; silicone polymers; and higher fatty acids. Examples of the derivatives include oxides, block copolymers of a vinyl-based monomer and wax, and graft-modified derivatives of a vinyl-based monomer and wax. The usage of the wax may be appropriately selected from a wide range without particularly limitation, but it is preferably 0.2 part by weight to 20 parts by weight, more preferably 0.5 part by weight to 10 parts by weight, and particularly preferably 1.0 part by weight to 8.0 parts by weight, based on 100 parts by weight of the binder resin.

Further, when the crystal nucleating agent is contained in the toner base particles, the toner composition of the binder resin, the colorant, and the like may be mixed with the crystal nucleating agent. In this case, as the crystal nucleating agent, the fatty acid amide or sorbitol-based compound as described above may be used.

The toner base particles obtained in the toner base particle producing step S1 preferably have a volume average particle size of from 4 μm to 8 μm. When the volume average particle size of the toner base particles falls in a range of from 4 μm to 8 μm, it is possible to stably form a high-definition image for a long time. Moreover, by reducing the particle size to this range, a high image density is obtained even with a small amount of adhesion, which generates an effect capable of reducing an amount of toner consumption. When the volume average particle size of the toner base particles is less than 4 μm, the particle size of the toner base particles becomes too small and high charging and low fluidity are likely to occur. When the high charging and the low fluidity occur, a toner is unable to be stably supplied to a photoreceptor and a background fog and image density decrease are likely to occur. When the volume average particle size of the toner base particles exceeds 8 μm, the particle size of the toner base particles becomes large and the layer thickness of a formed image is increased so that an image with remarkable granularity is generated and the high-definition image is not obtainable. In addition, as the particle size of the toner base particles is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Fine Resin Particle Preparation Step S2

In the fine resin particle preparation step S2, dried amorphous fine resin particles and crystalline polyester fine resin particles are prepared.

<Amorphous Fine Resin Particles/Crystalline Polyester Fine Resin Particles>

The amorphous fine resin particles and crystalline polyester fine resin particles can be obtained for example by subjecting a resin used as a raw material for the fine resin particles to the process of emulsification and dispersion using a homogenizer or the like, followed by performing grain refinement. Alternatively it can be obtained through polymerization of resin monomer components.

For drying, any type of method may be used, and for example, a method such as heated-air direct drying, conduction heat-transfer drying, far-infrared radiation drying, microwave radiation drying, and the like can be used to obtain dried fine resin particles. The fine resin particles are used as a shell material for covering the toner base particles in the subsequent coating step S3. By coating the toner base particles, for example, it is possible to prevent occurrence of the toner aggregation during preservation by melting of a low melting-point component such as a releasing agent contained in the toner base particle. Moreover, when the toner base particles are coated, for example, by spraying the liquid in which the fine resin particles are dispersed, the shapes of the fine resin particles are retained on the surfaces of the toner base particles. This makes it possible to obtain a toner which is superior in cleanability compared with a toner having smoothed surfaces.

As the raw materials for the amorphous fine resin particles and the crystalline polyester fine resin particles, for example, the resins used as the toner materials can be used, and examples thereof include a polyester resin, an acrylic resin, a styrene resin, and a styrene-acrylate copolymer.

The resin used as the raw material can be classified into an amorphous resin and a crystalline resin according to the difference in the macromolecule arrangement state.

The amorphous resin has a low crystallinity, in which the macromolecules are in the amorphous state, and is a resin in which the crystallinity index of less than 0.6 or more than 1.5. The crystalline resin is a resin in which the macromolecules have a regular molecule structure, the ratio of the crystals in the resin (crystallization degree) is high, and the crystallinity index is 0.6 to 1.5 of the resin.

An crystallinity index is a value defined by a ratio of a softening temperature of the resin to the highest temperature of an endothermic peak (softening temperature)/(highest temperature of endothermic peak), and it is indicative of the crystallinity. The highest temperature of the endothermic peak refers to the temperature of, among the endothermic peaks observed, the peak at the highest temperature point. When a difference between the highest temperature of the endothermic peak and the softening temperature is 20° C. or lower, then the peak temperature is defined as a melting point. When the difference between the highest temperature of the endothermic peak and the softening temperature exceeds 20° C., then the peak temperature is determined to be ascribable to glass transition.

The degree of crystallization can be adjusted by the kind and ratio of the raw material monomers, and the preparation condition (for example, the reaction temperature, the reaction time, the cooling rate, and the like).

The volume average particle size of the amorphous fine resin particles and the crystalline polyester fine resin particles needs to be sufficiently smaller than the average particle size of the toner base particles, and it is preferably from 0.05 μm to 1 μm, and more preferably from 0.1 μm to 0.5 μm. When the volume average particle size of the fine resin particles is from 0.05 μm to 1 μm, a protruding portion with a suitable size is formed on the surfaces of the toner base particles, whereby the toner prepared by the method of the invention is easily caught by cleaning blades at the time of cleaning, resulting in improvement of the cleanability.

Furthermore, the volume median particle size of the crystalline polyester fine resin particles is preferably smaller than that of the amorphous fine resin particles. For example, the ratio of the volume median particle size of the crystalline polyester fine resin particles to that of the amorphous fine resin particles is preferably 50% to 100%. If the ratio of the volume median particle size of the crystalline polyester fine resin particles to that of the amorphous fine resin particles is less than 50%, there occurs a problem that it is hard to handle the crystalline polyester fine resin particles, and thus, the toner base particles cannot be suitably coated, whereas if the ratio is more than 100%, there occurs a problem that the preservability of the toner is deteriorated by the crystalline resin.

The total additive amount of the amorphous fine resin particles and the crystalline polyester fine resin particles is preferably 3 parts by weight or more based on 100 parts by weight of the toner base particle. If it is less than 3 parts by weight, it is hard to coat the toner base particles uniformly, and according to the kind of the toner base particles, preservation stability may be deteriorated.

<Amorphous Resin>

The amorphous resin contained in the amorphous fine resin particles refers to a resin having a crystallinity index of more than 1.5 or less than 0.6, and the amorphous resin used in the invention is preferably one having a crystallinity index of more than 1.5. Examples of the amorphous resin include styrene-based resins such as a polystyrene resin; acryl-based resins such as a styrene-acrylate copolymer resin, or polymethyl methacrylate; polyolefin-based resins such as polyethylene; polyester resins; polyurethane; and epoxy resins.

The hydrophobicity of the styrene-acrylate copolymer resin can be controlled by blending of the monomers, and it is possible to inhibit reduction in charging under a high temperature/high humidity environment. Further, by selecting a polymerization degree and a blending ratio, a degree of freedom in heat design is high and the resin can be appropriately used as a toner material.

As the acrylic monomer of the styrene-acrylate copolymer resin, a known one can be used, and examples thereof include one which may have a substituent such as acrylic acid, methacrylic acid, acrylate, or methacrylate. Specific examples of the acrylic monomer include acrylate-based monomers such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, or dodecyl acrylate; methacrylate-based monomers such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, or decyl methacrylate, dodecyl methacrylate; and hydroxyl group-containing (meth)acrylate-based monomers such as hydroxyethyl acrylate, or hydroxypropyl methacrylate. The acrylic monomers may be used each alone, or two or more of them may be used in combination.

As the styrene-based monomer of the styrene-acrylate copolymer resin, a known one can be used, and examples thereof include styrene, and α-methyl styrene. The styrene-based monomers may be used each alone, or two or more of them may be used in combination. The polymerization of these monomers is carried out by the use of a commonly-used radical initiator in accordance with solution polymerization, suspension polymerization, emulsion polymerization, or the like.

The polyester resin has a high refractive index and excellent optical characteristics, and thus, is superior as a binder for a colorant such as a pigment, and also, it has high freedom in heat design and can be controlled in terms of its melting characteristics at a low temperature. Consequently, it can be appropriately used particularly in a low-temperature fixability toner.

The amorphous polyester resin can be obtained by polycondensing an alcohol component containing 60% by mole or more of an aliphatic diol having 3 to 10 carbon atoms and a carboxylic acid component containing 80% by mole or more of an aromatic dicarboxylic acid compound and 1 to 50% by mole of a polycyclic aromatic dicarboxylic acid compound having 12 or more carbon atoms as an aromatic dicarboxylic acid compound. It is preferable that the amorphous polyester resin can be obtained by polycondensing an alcohol component containing 80% by mole or more of an aliphatic diol having 4 to 10 carbon atoms and a carboxylic acid component containing 80% by mole or more of an aromatic dicarboxylic acid compound and 1 to 50% by mole of a polycyclic aromatic dicarboxylic acid compound having 12 or more carbon atoms as an aromatic dicarboxylic acid compound.

The aliphatic diol having 3 to 10 carbon atoms is preferably a linear aliphatic diol having 4 to 10 carbon atoms or a branched aliphatic diol having 3 to 10 carbon atoms. Since the binder resin contains a polyester resin having a high crystallinity obtainable from an alcohol component containing a linear aliphatic diol as a main component, and further containing a branched aliphatic diol, and a carboxylic acid component containing an aromatic carboxylic acid compound, used as raw material monomers, the low-temperature fixability can be further improved. The branched aliphatic diol refers to a diol having a branched alkylene group to which two OH groups are bonded, or a diol having a secondary OH group.

Examples of the linear aliphatic diol having 4 to 10 carbon atoms include 1,4-butanediol, 1,5-pentanediol, 1,6-hexanediol, 1,7-heptanediol, 1,8-octanediol, 1,9-nonanediol, 1,10-decanediol, and 1,4-butenediol, and from the viewpoint of enhancement of the crystallinity, α,ω-linear alkanediols are preferable, and 1,4-butanediol, 1,6-hexanediol, 1,8-octanediol, and 1,10-decanediol are more preferable. The content of the linear aliphatic diol having 4 to 10 carbon atoms in the alcohol component is preferably from 50 to 90% by mole, and the content is more preferably from 60 to 90% by mole from the viewpoint of enhancement of the crystallinity.

Examples of the branched aliphatic diol having 3 to 10 carbon atoms include 1,2-propanediol, 1,3-butanediol, neopentylglycol, and 2-butyl-2-ethyl-1,3-propanediol. The content of the branched aliphatic diol having 3 to 10 carbon atoms in the alcohol component is preferably from 10 to 50% by mole, and the content is more preferably from 10 to 40% by mole from the viewpoint of improving the low-temperature fixability.

The molar ratio of the linear aliphatic diol having 4 to 10 carbon atoms to the branched aliphatic diol having 3 to 10 carbon atoms (the linear aliphatic diol having 4 to 10 carbon atoms/the branched aliphatic diol having 3 to 10 carbon atoms) is preferably 60/40 to 90/10, more preferably 70/30 to 85/15, and from the viewpoint of low-temperature fixability, even more preferably 70/30 to 80/20.

The content of the aliphatic diol having 3 to 10 carbon atoms in the alcohol component is 60% by mole or more, preferably 80% by mole or more, and the content is more preferably 85% by mole or more from the viewpoint of enhancement of the crystallinity.

An alcohol other than the above-mentioned aliphatic diol having 3 to 10 carbon atoms may be contained in the alcohol component within the range so as not to impair the effects of the invention. Examples of the alcohol component include an aliphatic diol other than the aliphatic diol having 3 to 10 carbon atoms, such as ethylene glycol; an aromatic diol such as an alkylene oxide adduct of bisphenol A represented by polyoxypropylene(2.2)-2,2-bis(4-hydroxyphenyl)propane or polyoxyethylene(2.2)-2,2-bis(4-hydroxyphenyl)propane; an alicyclic diol such as 1,4-cyclohexanedimethanol; and a trihydric or higher polyhydric alcohol such as glycerol, pentaerythritol.

The aromatic dicarboxylic acid compound is preferably a compound having a benzene backbone such as phthalic acid, isophthalic acid, terephthalic acid, or their derivatives such as an acid anhydride thereof or an alkyl (having 1 to 3 carbon atoms) ester thereof. The content of the aromatic dicarboxylic acid compound in the carboxylic acid component is 80% by mole or more, and the content is preferably 85% by mole or more from the viewpoint of low-temperature fixability, durability, and charging stability under high-temperature/high-humidity conditions.

The polycyclic aromatic dicarboxylic acid compound having 12 or more carbon atoms is preferably a compound having a benzene backbone such as 2,6-naphthalenedicarboxylic acid, 1,5-naphthalenedicarboxylic acid, 2,7-naphthalenedicarboxylic acid, 1,4-naphthalenedicarboxylic acid, 4,4-biphenyldicarboxylic acid, or their derivatives such as an acid anhydride thereof or an alkyl (having 1 to 3 carbon atoms) ester thereof. The number of carbon atoms of the polycyclic aromatic dicarboxylic acid compound is preferably from 12 to 30, and more preferably from 12 to 24. Among them, 2,6-naphthalenedicarboxylic acid and 1,5-naphthalenedicarboxylic acid are preferable from the viewpoint of the crystallinity of the polyester resin. The content of the polycyclic aromatic dicarboxylic compound having 12 or more carbon atoms in the carboxylic acid component is 1 to 50% by mole, and the content is preferably 5 to 40% by mole, and more preferably 10 to 30% by mole, from the viewpoint of crystallinity of the polyester resin and low-temperature fixability of the toner.

The total content of the aromatic dicarboxylic acid compound and the polycyclic aromatic dicarboxylic acid compound in the carboxylic acid component is preferably 80% by mole or more, and it is preferably from 85% by mole or more, and more preferably 90 to 100% by mole, from the viewpoint of low-temperature fixability, durability, and charging stability under a high-temperature/high-humidity condition.

Examples of the carboxylic acid component other than the aromatic dicarboxylic acid compound include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecyl succinic acid, or n-dodecenyl succinic acid; alicyclic dicarboxylic acids such as cyclohexane dicarboxylic acid; tricarboxylic or higher carboxylic acids such as trimellitic acid or pyromellitic acid; and their derivatives such as an acid anhydride thereof or an alkyl (having 1 to 3 carbon atoms) ester thereof.

Furthermore, the glass transition temperature of the amorphous resin contained in the amorphous fine resin particles is preferably higher than the glass transition temperature of the binder resin contained in the toner base particles, and more preferably 50° C. or higher.

<Crystalline Polyester Resin>

The crystalline polyester resin refers to a polyester resin having a crystallinity index of 0.6 to 1.5. The crystalline polyester resin used in the invention preferably has a crystallinity index of 0.8 to 1.2. In accordance with a known method, for example, the method disclosed in JP-A 2006-113473, the crystalline polyester resin is prepared through a polycondensation reaction of an alcohol component and a carboxylic acid component used as raw material monomers.

It is preferable that the alcohol component contains a compound capable of promoting the resin crystallinity, such as an aliphatic diol having 2 to 8 carbon atoms.

Examples of the aliphatic diol having 2 to 8 carbon atoms include ethylene glycol, 1,2-propylene glycol, 1,3-propylene glycol, 1,4-butanediol, 1,5-pentanediol, 1,6-hexanediol, 1,7-heptanediol, 1,8-octanediol, neopentylglycol, and 1,4-butenediol. In particular, an $\alpha,\omega$-linear alkane diol is preferable.

It is preferable that the aliphatic diol having 2 to 8 carbon atoms is contained in the alcohol component in an amount of 80% by mole or more from the viewpoint of attaining high crystallinity. Moreover, it is more preferable that the aliphatic diol of one constitutes 70% by mole or more of the entire alcohol component.

Examples of the carboxylic acid component include a carboxylic acid and a derivative thereof such as carboxylic acid anhydride or carboxylic acid ester. Among them, the carboxylic acid is preferable.

Examples of the carboxylic acid include aliphatic dicarboxylic acids having 2 to 30 carbon atoms such as fumaric acid, adipic acid, oxalic acid, malonic acid, maleic acid, citraconic acid, itaconic acid, glutaconic acid, succinic acid, sebacic acid, azelaic acid, n-dodecyl succinic acid, or n-dodecenyl succinic acid; aromatic dicarboxylic acids such as phthalic acid, isophthalic acid, or terephthalic acid; alicyclic dicarboxylic acids such as cyclohexane dicarboxylic acid; tricarboxylic or higher carboxylic acids such as trimellitic acid or pyromellitic acid. Among them, from the viewpoint of high degree of crystallinity, aliphatic dicarboxylic acids are preferable, and aliphatic dicarboxylic acids having 2 to 8 carbon atoms are more preferable. The content of the aliphatic dicarboxylic acid in the carboxylic acid component is preferably 70% by mole or more.

In regard to a mole ratio between the alcohol component and the carboxylic acid component in the crystalline polyester resin, in order to provide the crystalline polyester resin with a macromolecule, it is preferable that the alcohol component is larger in content than the carboxylic acid component. Moreover, from the viewpoint of easily adjusting the molecular weight of the polyester resin by distilling the alcohol component off during the reaction under reduced pressure, it is preferable that the mole ratio (carboxylic acid component/alcohol component) is 0.9 or more and less than 1.

In the preparation of the crystalline polyester resin, the polycondensation reaction of the alcohol component and the carboxylic acid component can be carried out, for example, at a temperature in a range of from 120 to 230° C. under an inert gas atmosphere, and if needed, using an esterification catalyst.

(3) Coating Step S3

The coating step S3 includes a mixed fine resin particle adhering step S3*a*, a temperature regulation step S3*b*, a spraying step S3*c*, a film-forming step S3*d*, and a collecting step S3*e*.

(3)-1 Mixed Fine Resin Particle Adhering Step S3*a*

In the mixed fine resin particle adhering step S3*a*, first, the amorphous fine resin particles prepared in the fine resin particle preparation step S2 and the crystalline polyester fine resin particles are mixed using a mixer such as a HENSCHEL MIXER to obtain mixed fine resin particles. At this time, a crystal nucleating agent may be added to the mixed fine resin particles. The added crystal nucleating agent is spread on the crystalline polyester resin surface by a liquid such as ethanol which will be sprayed in a spraying step as described later, to promote crystallization of the crystalline polyester fine resin particles. Thus, when the crystal nucleating agent is added into the mixed fine resin particles, the above-described fatty acid amide or sorbitol-based compound can be used as the crystal nucleating agent.

The content of the crystalline polyester fine resin particles in the mixed fine resin particles is preferably from 20% by weight to 50% by weight. If the content of the crystalline polyester fine resin particles in the mixed fine resin particles is less than 20% by weight, the effect of melting the resin coating layer is not sufficient, and the low-temperature fixability is deteriorated. If the content of the crystalline polyester fine resin particles is more than 50% by weight, the heat resistance effect of the amorphous resin is not applied and the improvement of preservability becomes harder.

In the mixed fine resin particles, crystalline resin particles are uniformly present among the amorphous resin particles, whereby when the resin coating layer is formed, the effects of these resins are exerted.

Next, the mixed fine resin particles and the toner base particles produced in the toner base particle producing step S1 are mixed with a mixer such as a HENSCHEL MIXER to obtain mixed fine resin particle-adhered particles in which mixed fine resin particles are adhered to the surfaces of the toner base particles.

As the mixer, a known one can be used, and examples thereof include HENSCHEL MIXER (trade name, manufactured by Mitsui Mining Co., Ltd.), SUPERMIXER (trade name, manufactured by Kawata MFG Co., Ltd.), and MECHANOMILL (trade name, manufactured by Okada Seiko Co., Ltd.)

<Toner Manufacturing Apparatus>

Figure 2:
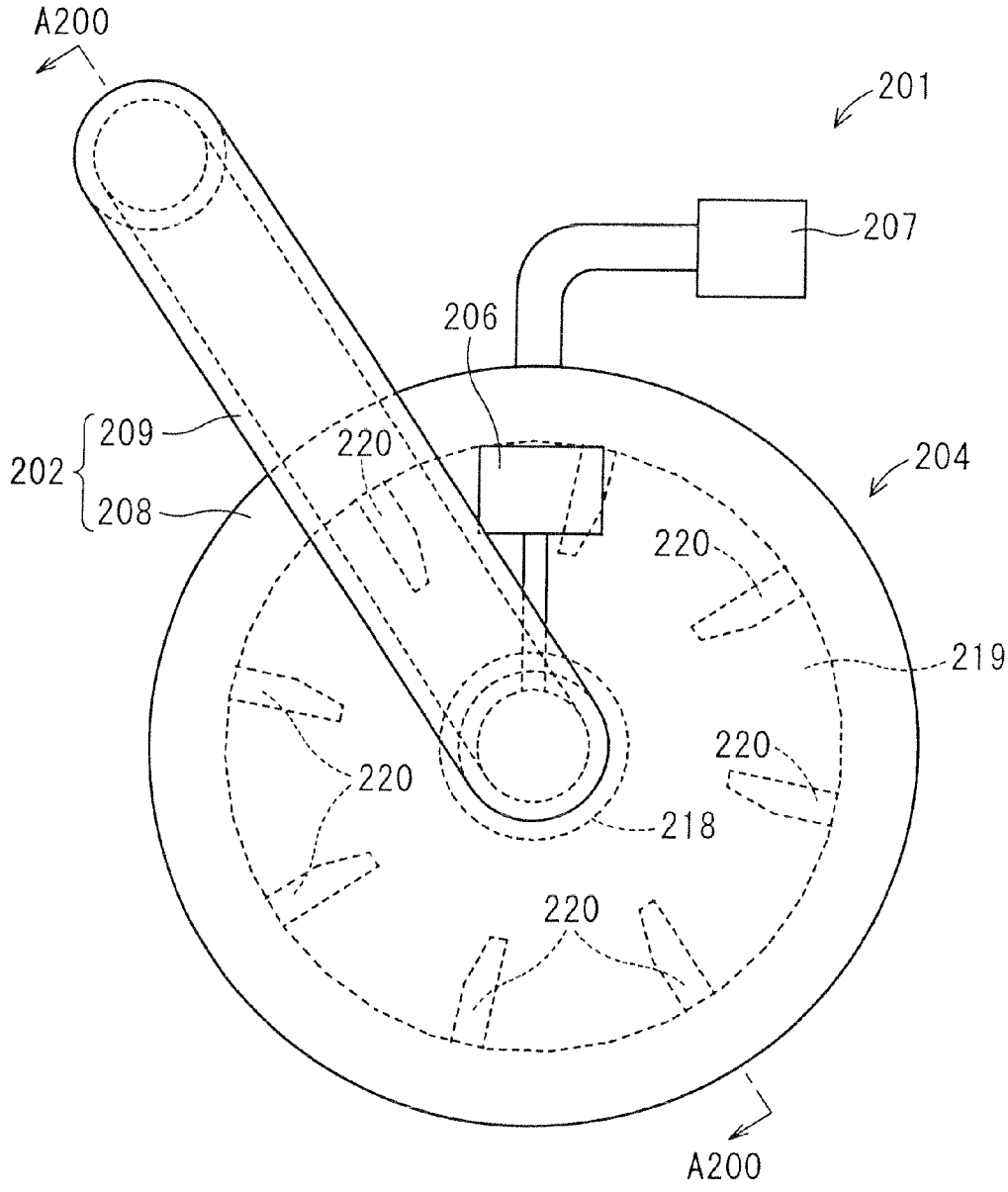
FIG. 2 is a front view showing the configuration of a toner manufacturing apparatus used in the method for manufacturing a capsule toner of the invention.
Figure 3:
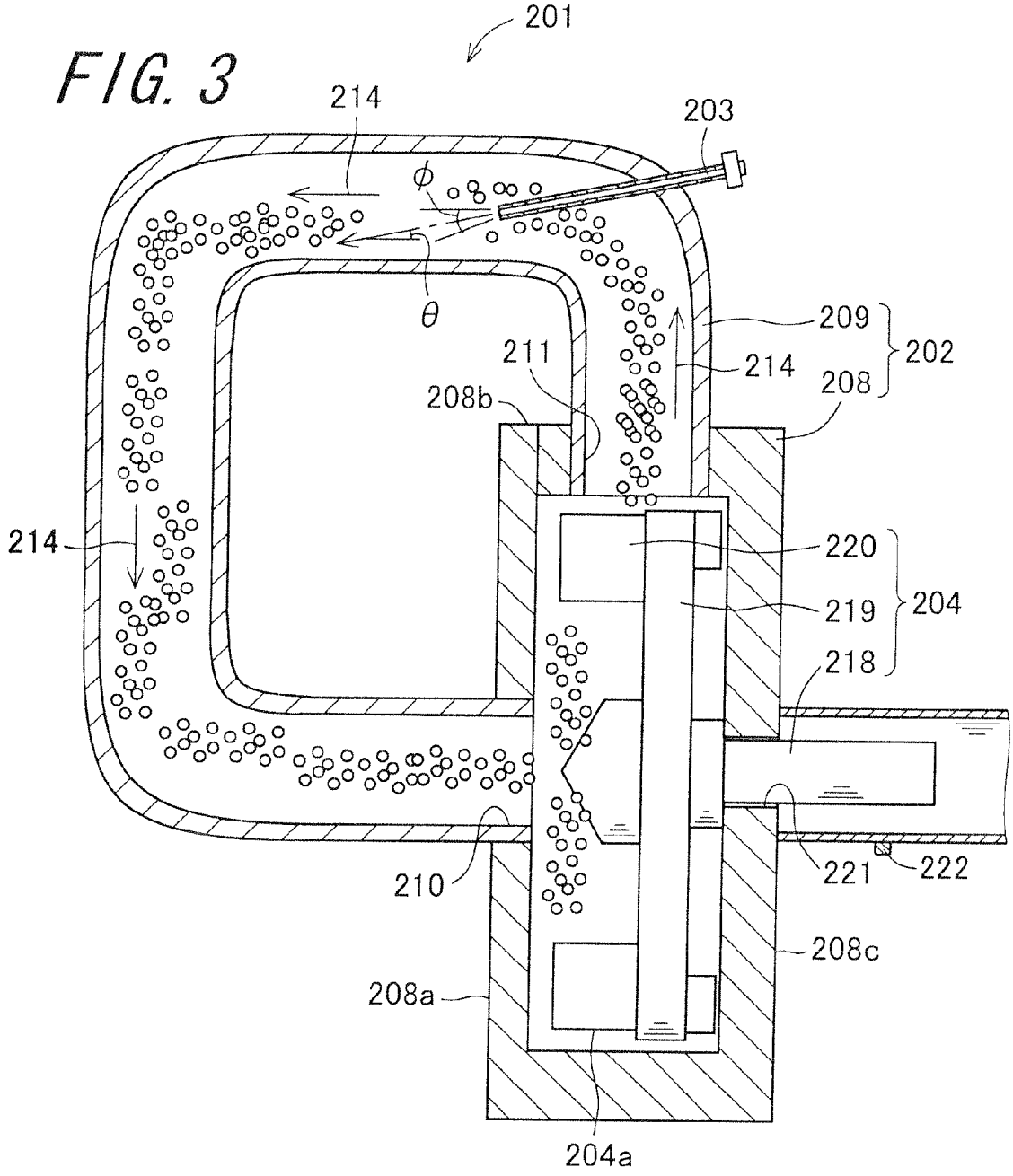
FIG. 3 is a schematic sectional view showing the toner manufacturing apparatus shown in FIG. 2 taken along the line A200-A200.

FIG. 2 is a front view showing the configuration of a toner manufacturing apparatus 201 used in the method for manufacturing a capsule toner of the invention. FIG. 3 is a schematic sectional view showing the toner manufacturing apparatus 201 shown in FIG. 2 taken along the line A200-A200. In the coating step S3, the toner manufacturing apparatus 201 shown in FIG. 2, for example, is used, and the resin coating layer is formed on the surface of the toner base particle by impact force due to synergetic effect of circulation and agitation in the toner manufacturing apparatus. The toner manufacturing apparatus 201 is a rotary stirring apparatus, and includes a powder passage 202, a spraying section 203, a rotary stirring section 204, a temperature regulation jacket (not shown), a powder inputting section 206, and a powder collecting section 207. The rotary stirring section 204 and the powder passage 202 constitute a circulating section.

(Powder Passage)

The powder passage 202 comprises a stirring section 208 and a powder flowing section 209. The stirring section 208 is a cylindrical container-like member having an internal space. Openings 210 and 211 are formed in the stirring section 208 which is a rotary stirring chamber. The opening 210 is formed at an approximate center part of a surface 208*a* in one side of the stirring section 208 in the axial direction so as to penetrate a side wall including the surface 208*a* of the stirring section 208 in a thickness direction thereof. Moreover, the opening 211 is formed at a side surface 208*b* perpendicular to the surface 208*a* in one side of the axial direction of the stirring section 208 so as to penetrate a side wall including the side surface 208*b* of the stirring section 208 in a thickness direction thereof. The powder flowing section 209 which is a circulating tube has one end connected to the opening 210 and the other end connected to the opening 211. Thus, the internal space of the stirring section 208 and the internal space of the powder flowing section 209 are communicated to form the powder passage 202. The mixed fine resin particle-adhered particles and the gas flow through the powder passage 202. The powder passage 202 is provided so that a powder flowing direction which is a direction in which the mixed fine resin particle-adhered particles flow is constant.

A temperature in the powder passage 202 is set at not higher than a glass transition temperature of the toner base particles, and is preferably 30° C. or higher and not higher than the glass transition temperature of the toner base particles. The temperature in the powder passage 202 is almost uniform at any part by fluidity of the toner base particles. When the temperature in the passage exceeds the glass transition temperature of the toner base particles, there is a possibility that the toner base particles are softened excessively and aggregation of the toner base particles is generated. Further, in a case where the temperature is lower than 30° C., the drying speed of a dispersion liquid is made slow and the productivity is lowered. Accordingly, in order to prevent aggregation of the toner base particles, it is necessary that the temperature of the powder passage 202 and the rotary stirring section 204, which will be described below, is maintained at not higher than the glass transition temperature of the toner base particles. Thus, the temperature regulation jacket, which will be described below, whose inner diameter is larger than an external diameter of the powder passage tube is disposed at least on a part of an outside of the powder passage 202 and the rotary stirring section 204.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted into a through-hole 221 penetrating a side wall including a surface 208*c* disposed on the other side of the axial direction of the stirring section 208, in a thickness direction thereof, and that is rotated around its axis by a motor (not shown). The rotary disc 219 is a discotic member supported by the rotary shaft member 218 so that an axis thereof matches the axis of the rotary shaft member 218 and rotating with rotation of the rotary shaft member 218. The plurality of stirring blades 220 are supported by a peripheral edge portion of the rotary disc 219 and are rotated with rotation of the rotary disc 219.

In the coating step S3, the outermost peripheral speed of the outermost peripheral of the rotary stirring section 204 is preferably set to 30 m/sec or more, and more preferably to 50 m/sec or more. The outermost peripheral of the rotary stirring section 204 is a part 204*a* of the rotary stirring section 204 that has the longest distance from the axis of the rotary shaft member 218 in a direction perpendicular to a direction in which the rotary shaft member 218 of the rotary stirring section 204 extends. When the peripheral speed in the outermost peripheral of the rotary stirring section 204 is set to 30 m/sec or more at the time of rotation, it is possible to isolate and fluidize the mixed fine resin-particle-adhered particles. When the peripheral speed in the outermost peripheral is less than 30 m/sec, it is impossible to isolate and fluidize the mixed fine resin particle-adhered particles, thus making it impossible to uniformly coat the toner base particles with the resin film.

The mixed fine resin particle-adhered particles preferably collide with the rotary disc 219 perpendicularly. This makes it possible to stir the mixed fine resin particle-adhered particles sufficiently and coat the toner base particles with the mixed fine resin particles more uniformly, and to further improve yield of the toner with the uniform coating layer.

(Spraying Section)

The spraying section 203 is provided so as to be inserted in an opening formed in an outer wall of the powder passage 202 and is provided, in the powder flowing section 209, on the powder flowing section which is on the closest side to the opening section 211 in the flowing direction of the mixed fine resin particle-adhered particles. The spraying section 203 includes a liquid reservoir for reserving a liquid, a carrier gas feeding section for feeding carrier gas, and a two-fluid nozzle for mixing the liquid and the carrier gas, ejecting the obtained mixture to the toner base particles present in the powder passage 202, and spraying liquid-droplets of the liquid to the toner base particles. As the carrier gas, compressed air can be used. The liquid is fed to the spraying section 203 by a liquid feeding pump with a constant flow amount and the plasticizing liquid sprayed by the spraying section 203 is gasified so that the gasified plasticizing liquid is spread on the surfaces of the toner base particles and the mixed fine resin particles surface. Thus, the toner base particles and the mixed fine resin particles are plasticized.

(Temperature Regulation Jacket)

The temperature regulation jacket (not shown) is provided at least on a part of the outside of the powder passage 202 and regulates the temperature in the powder passage 202 and of the rotary stirring section 204 to a predetermined temperature by passing a cooling medium or a heating medium through the space inside the jacket. This makes it possible to control the temperatures in the powder passage and an outside of the rotary stirring section at not higher than a temperature at which the toner base particles and the mixed fine resin particles in the temperature regulation step S3*b* described below are not softened and deformed. Thus, in the spraying step S3*c* and the film-forming step S3*d*, a variation in the temperature applied to the toner base particles, the mixed fine resin particles, and the liquid is reduced and this makes it possible to keep the stable fluid state of the mixed fine resin particle-adhered particles.

In this embodiment, the temperature regulation jacket is preferably provided over the entire outside of the powder passage 202. Although the mixed fine resin particle-adhered particles generally collide with an inner wall of the powder passage many times, a part of the collision energy is converted into the thermal energy at the time of collision and is accumulated in the toner base particles and the mixed fine resin particles. As the number of collisions increases, the thermal energy accumulated in the particles increases and then the toner base particles and the mixed fine resin particles are softened and are adhered to the inner wall of the powder passage. By providing the temperature regulation jacket over the entire outside of the powder passage 202, an adhesive force of the toner base particles and the mixed fine resin particles is reduced to the inner wall of the powder passage, it is possible to prevent adhesion of the toner base particles to the inner wall of the powder passage 202 due to a sudden rise of the temperature in the apparatus reliably and to avoid an inside of the powder passage being narrowed by the toner base particles and the mixed fine resin particles. Accordingly, the toner base particles are coated with the mixed fine resin particles uniformly and it is possible to manufacture a toner having excellent cleaning property at high yield.

Furthermore, in the inside of the powder flowing section 209 downstream of the spraying section 203, the plasticizing liquid sprayed is not dried and remains therein. Where the temperature is not appropriate, the drying rate becomes slow, and the plasticizing liquid easily remains. Where the toner base particles are in contact with the residual liquid, the toner base particles are easily adhered to the inner wall of the powder passage 202. This may be the generation source of aggregation of the toner. On the inner wall in the vicinity of the opening 210, the mixed fine resin particle-adhered particles flowing into the stirring section 208 easily collide with the mixed fine resin particle-adhered particles flown into the stirring section 208 by the stirring by the rotary stirring section 204. Due to this, the toner base particles collided easily adhere to the vicinity of the opening 210. Therefore, adhesion of the toner base particles to the inner wall of the powder passage 202 can be further securely prevented by providing the temperature regulation jacket in an area to which the toner base particles easily adhere.

(Powder Inputting Section and Powder Collecting Section)

Figure 4:
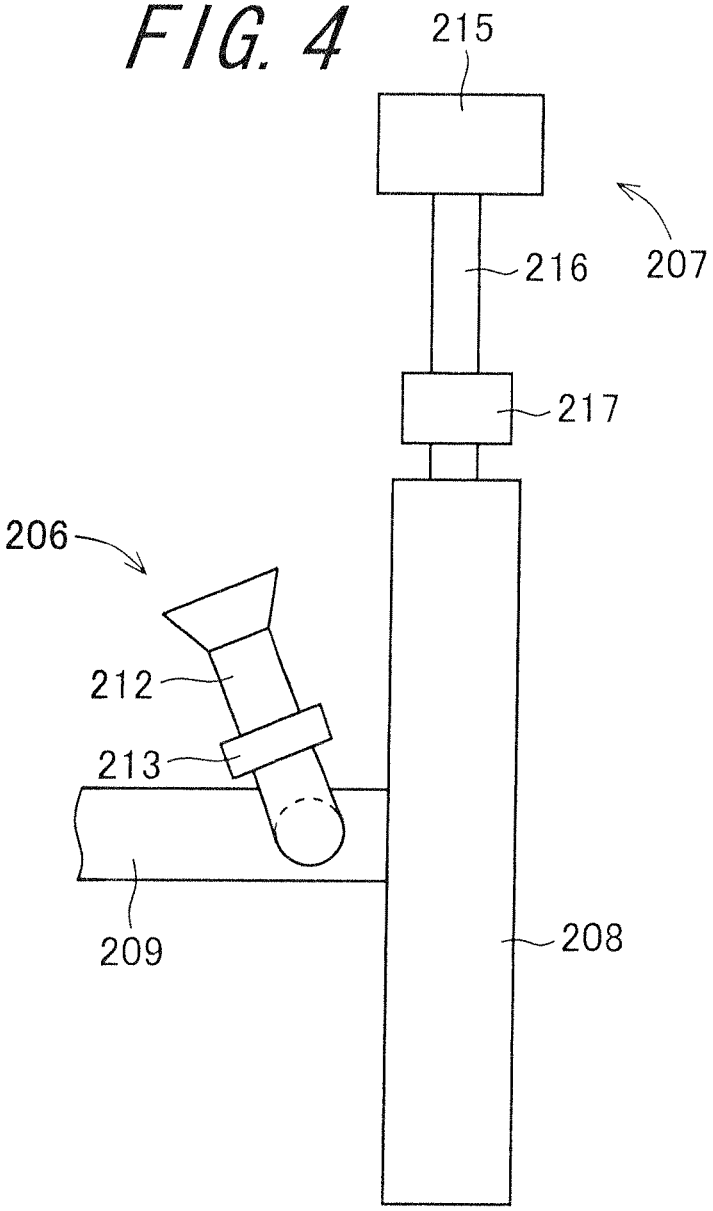
FIG. 4 is a side view of a configuration around a powder inputting section and a powder collecting section.

The powder flowing section 209 of the powder passage 202 is connected to the powder inputting section 206 and the powder collecting section 207. FIG. 4 is a side view of a configuration around the powder inputting section 206 and the powder collecting section 207.

The powder inputting section 206 includes a hopper (not shown) that feeds the mixed fine resin particle-adhered particles, a feeding tube 212 that communicates the hopper and the powder passage 202, and an electromagnetic valve 213 provided in the feeding tube 212. The mixed fine resin particle-adhered particles fed from the hopper are fed to the powder passage 202 through the feeding tube 212 in a state where the passage in the feeding tube 212 is opened by the electromagnetic valve 213. The mixed fine resin particle-adhered particles fed to the powder passage 202 flow in the constant powder flowing direction with stirring by the rotary stirring section 204. Moreover, the mixed fine resin particle-adhered particles are not fed to the powder passage 202 in a state where the passage in the feeding tube 212 is closed by the electromagnetic valve 213.

The powder collecting section 207 includes a collecting tank 215, a collecting tube 216 that communicates with the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage in the collecting tube 216 is closed by the electromagnetic valve 217.

(3)-2 Temperature Regulation Step S3*b*

In the temperature regulation step S3*b*, while the rotary stirring section 204 is rotated, temperatures in the powder passage 202 and of the rotary stirring section 204 are regulated to a predetermined temperature by passing a medium through the temperature regulation jacket disposed on the outside thereof. This makes it possible to control the temperature in the powder passage 202 at not higher than a temperature at which the mixed fine resin particle-adhered particles that are inputted in the spraying step S3*c* described below are not softened and deformed.

(3)-3 Spraying Step S3*c*

In the spraying step S3*c*, a liquid having an effect of not dissolving but plasticizing the toner base particles and the mixed fine resin particles (spray solution) is sprayed from the above-described spraying section 203 by carrier gas, while fluidizing the mixed fine resin particle-adhered particles.

The spray solution preferably contains a crystal nucleating agent in order to promote crystallization of the crystalline polyester fine resin particles. The crystal nucleating agent may be dissolved in the spray solution or dispersed in the spray solution. A commonly used emulsifying apparatus or dispersing apparatus can be used for the dissolution or dispersion treatment.

A commonly used dispersion medium can be used in order to finely disperse the crystal nucleating agent. This dispersion medium can be appropriately selected according to the dissolution in or compatibility with the crystal nucleating agent, and a mixture of plural kinds thereof may be used. As the dispersion medium, alcohols and the like which are easily handled are preferably used from the viewpoint of the relationship with the next step.

The crystal nucleating agent is preferably dissolved or dispersed in the spray solution to a volume 50% particle size (volume average particle size) of 0.5 μm or less. Examples of the method for adjusting the particle size of the crystal nucleating agent include a method in which a crystal nucleating agent is put into ethanol as a dispersion medium (5 g of the crystal nucleating agent is put into 45 ml of ethanol), and pulverized for a predetermined period of time (for example, 5 hours) by a pulverization apparatus (trade name: Planetary Ball Mill PM100, manufactured by Retsch Co., Ltd.). Thus, the crystal nucleating agent is dissolved or dispersed in the dispersion medium, and then ethanol is added to provide the crystal nucleating agent to a predetermined concentration to prepare a spray solution. Further, the particle size of the crystal nucleating agent dispersed in the spray solution can be measured by a laser diffraction scattering-type particle size distribution-measuring apparatus.

Furthermore, when the spray solution in which the crystal nucleating agent is dissolved or dispersed is prepared, a sorbitol-based compound is preferably used as the crystal nucleating agent from the viewpoint of solubility in a dispersion medium such as ethanol.

The mixed fine resin particle-adhered particles are fed from the powder inputting section 206 to the powder passage 202 in a state where the rotary shaft member 218 of the rotary stirring section 204 is being rotated. The mixed fine resin particle-adhered particles fed to the powder passage 202 are stirred by the rotary stirring section 204 to flow through the powder flowing section 209 of the powder passage 202 in the direction indicated by an arrow 214.

The sprayed liquid is gasified so that the inside of the powder passage 202 has a constant gas concentration and the gasified liquid is preferably ejected outside the powder passage through the through-hole 221. This makes it possible to keep the concentration of the gasified liquid in the powder passage 202 constant and to make the drying speed of the liquid higher than the case where the concentration is not kept constant. Accordingly, it is possible to prevent the toner particles in which undried liquid remains adhering to other toner particles and to further suppress aggregation of the toner particles. As a result, it is possible to further improve the yield of the toner particle with the uniform coating layer.

The concentration of the gasified liquid measured by a concentration sensor in a gas exhausting section 222 is preferably around 3% or less. When the concentration of the gasified liquid is around 3% or less, the drying speed of the liquid is able to be increased sufficiently, thus making it possible to prevent adhesion of the undried toner particles in which the liquid remains to other toner particles and to prevent aggregation of the toner particles. Moreover, the concentration of the gasified liquid is more preferably 0.1% or more and 3.0% or less. When the concentration falls within this range, it is possible to prevent aggregation of the toner particles without deteriorating the productivity.

In the embodiment, spraying is preferably initiated after fluidizing rate of the mixed fine resin particle-adhered particles are stabilized in the powder passage 202. This can allow uniform spraying of the liquid to the mixed fine resin particle-adhered particles and can improve the yield of a toner with the uniform coating layer.

As a liquid having an effect of not dissolving but plasticizing the toner base particles and the mixed fine resin particles, it is not particularly limited, but it is preferably an easily evaporated liquid since its removal from the toner base particles and the mixed fine resin particles is necessary after spraying the liquid. Examples of such a liquid include a liquid containing a lower alcohol. Examples of the lower alcohol include methanol, ethanol, and propanol. When the liquid includes such a lower alcohol, it is possible to enhance wettability of the mixed fine resin particles as a coating material with respect to the toner base particles, and the mixed fine resin particles are adhered over the entire surface or a large part of the toner base particles, which easily allows further deformation and film formation. In addition, since the lower alcohol has a high vapor pressure, it is possible to further shorten the drying time at the time of removing the liquid and to suppress aggregation between the toner particles.

Further, the viscosity of the liquid to be sprayed is preferably 5 cP or less. The viscosity of the liquid is measured at 25° C., and can be measured, for example, by a cone-plate type rotation viscometer. A preferable example of the liquid having the viscosity of 5 cP or less includes alcohol. Examples of the alcohol include methyl alcohol and ethyl alcohol. These alcohols have low viscosity and are easily vaporized, and therefore, when the liquid includes the alcohol, it is possible to spray the liquid with a minute liquid-droplet diameter without increasing a liquid-droplet diameter of the liquid sprayed from the spraying section 203. It is also possible to spray the liquid with a uniform liquid-droplet diameter. It is possible to further promote fining of the liquid-droplet at the time of collision of the toner base particles and the liquid-droplet. This makes it possible to uniformly wet the surfaces of the toner base particles and the mixed fine resin particles with the liquid and to apply the liquid to the surfaces of the mixed fine resin particle-adhered particles, thereby softening the mixed fine resin particles by a synergic effect with collision energy. As a result, a coating toner with excellent uniformity can be obtained.

An angle θ formed by the liquid spraying direction which is a direction of the axis of the two-fluid nozzle of the spraying section 203 and the powder flowing direction which is a direction in which the mixed fine resin particle-adhered particles flow in the powder passage 202 is preferably 0° or more and 45° or less. When the angle θ falls within this range, the liquid-droplet of the liquid is prevented from recoiling from the inner wall of the powder passage 202 and the yield of the coating toner can be further improved. When the angle θ exceeds 45°, the liquid-droplet of the liquid easily recoils from the inner wall of the powder passage 202 and the liquid is easily retained, thereby generating aggregation of the toner particles and deteriorating the yield.

Further, a spreading angle ϕ of the liquid sprayed by the spraying section 203 is preferably 20° or more and 90° or less.

When the spreading angle ϕ falls out of this range, it is likely to be difficult to spray the liquid uniformly to the mixed fine resin particle-adhered particles.

(3)-4 Film-Forming Step S3*d*

In the film-forming step S3*d*, until the mixed fine resin particles adhered to the toner base particles are softened to form a film, stirring of the rotary stirring section 204 is continued at a predetermined temperature to fluidize the mixed fine resin particle-adhered particles, and the toner base particles are coated with the resin layers.

(3)-5 Collecting Step S3*e*

In the collecting step S3*e*, spraying of the liquid from the spraying section and rotation of the rotary stirring section 204 are stopped, and the capsule toner is ejected outside the apparatus from the powder collecting section 207, and thus collected.

The configuration of the toner manufacturing apparatus 201 is not limited to the above configuration and various alterations may be added thereto. For example, the temperature regulation jacket may be provided over the entire outside of the powder flowing section 209 and the stirring section 208, or may be provided in a part of the outside of the powder flowing section 209 or the stirring section 208. When the temperature regulation jacket is provided over the entire outside of the powder flowing section 209 and the stirring section 208, it is possible to prevent the toner base particles from being adhered to the inner wall of the powder passage 202 more reliably.

Furthermore, the toner manufacturing apparatus as described above can be also obtained by combining a commercially available stirring apparatus and the spraying section. An example of the commercially available stirring apparatus provided with a powder passage and a rotary stirring section includes a Hybridization system (trade name, manufactured by Nara Machinery Co., Ltd.) By installing a liquid spraying unit in the stirring apparatus, the stirring apparatus is usable as the toner manufacturing apparatus for manufacturing the capsule toner of the invention.

2. Toner

The capsule toner according to an embodiment of the invention is manufactured by the above-described method for manufacturing the toner. The capsule toner manufactured by the method for manufacturing the toner is excellent in durability and preservation stability by virtue of protection of the included components since the resin layer is formed on the surfaces of the toner base particles. Further, by performing image formation with the use of such a capsule toner, it is possible to form a good-quality image which exhibits high resolution and is free from density unevenness.

An external additive may be added to the capsule toner of the invention. As the external additive, a known one can be used, and examples thereof include silica and titanium oxide. Further, it is preferable that these substances be surface-treated with a silicone resin, a silane coupling agent, or the like. The usage of the external additive is preferably 1 part by weight to 10 parts by weight based on 100 parts by weight of the capsule toner.

3. Developer

A developer according to an embodiment of the invention includes the capsule toner according to the above embodiment. The developer of the present embodiment can be Used in the form of either a one-component developer or a two-component developer. When the developer is used in the form of the one-component developer, the toner is used alone without a carrier. A blade and a fur brush are used to effect the frictional electrification on a developing sleeve so that the toner is attached onto the sleeve, thereby conveying the toner to perform image formation. When the developer is used in the form of a two-component developer, the capsule toner of the above embodiment is used together with a carrier.

As the carrier, a known one can be used, and examples thereof include single or complex ferrite composed of iron, copper, zinc, nickel, cobalt, manganese, chromium, or the like; a resin-coated carrier having carrier core particles whose surfaces are coated with coating materials; and a resin-dispersion carrier in which magnetic particles are dispersed in a resin.

As the coating material, a known one can be used, and examples thereof include polytetrafluoroethylene, a monochlorotrifluoroethylene polymer, polyvinylidene fluoride, a silicone resin, a polyester resin, a metal compound of di-tertiary-butylsalicylic acid, a styrene-based resin, an acryl-based resin, a polyamide, polyvinyl butyral, nigrosine, an aminoacrylate resin, basic dyes or lakes thereof, fine silica powders, and fine alumina powders. In addition, the resin used for the resin-dispersion type carrier is not particularly limited, but examples thereof include a styrene-acrylic resin, a polyester resin, a fluorine-based resin, and a phenol resin. Both of the coating materials are preferably selected according to the toner components, and these may be used each alone, or two or more of them may be used in combination.

The carrier preferably has a spherical shape or a flattened shape. The particle size of the carrier is not particularly limited, but in consideration of forming higher-quality images, the particle size of the carrier is preferably 10 μm to 100 μm, and more preferably 20 μm to 50 μm. Further, the resistivity of the carrier is preferably $10^8$ Ω·cm or more, and more preferably $10^{12}$ Ω·cm or more.

The volume resistivity of the carrier is a value obtained from a current value determined as follows. The carrier particles are put into a container having a cross-sectional area of 0.50 $cm^2$, and then tapped. Subsequently, a load of 1 $kg/cm^2$ is applied by use of a weight to the particles which are held in the container. When an electric field of 1000 V/cm is generated between the load weight and a bottom electrode of the container by application of voltage, a current value is read. When the resistivity of the carrier is low, an electric charge will be injected into the carrier upon application of bias voltage to a developing sleeve, thus causing the carrier particles to be more easily attached to the photoreceptor. Further, breakdown of the bias voltage is more liable to occur.

Magnetization intensity (maximum magnetization) of the carrier is preferably 10 emu/g to 60 emu/g and more preferably 15 emu/g to 40 emu/g. Under the condition of ordinary magnetic flux density of the developing roller, however, no magnetic binding force work on the carrier having the magnetization intensity less than 10 emu/g, which may cause the carrier to spatter. The carrier having the magnetization intensity larger than 60 emu/g has bushes which are too large to keep the non-contact state with the image bearing member in the non-contact development or to possibly cause sweeping streaks to appear on a toner image in the contact development.

The use ratio of the toner to the carrier in the two-component developer is not particularly limited, and is appropriately selected according to kinds of the toner and carrier. For example, when mixing with the resin-coated carrier (having density of 5 $g/cm^2$ to 8 $g/cm^2$), the usage of the toner may be determined such that a content of the toner in the developer is 2% by weight to 30% by weight, and preferably 2% by weight to 20% by weight of the total amount of the developer. Further, the coverage of the carrier with the toner is preferably 40% to 80%.

EXAMPLES

Hereinafter, the invention will be specifically described with reference to Examples and Comparative Examples below. In the following description, unless otherwise noted, "part" and "%" represent "part by weight" and "% by weight" respectively. In Examples and Comparative Examples, a softening temperature and a glass transition temperature of the resin, a melting point of the release agent, a volume average particle size and a coefficient of variation of the toner base particles, and a crystallinity index and a volume median particle size (D50) of the fine resin particles were measured as follows.

[Softening Temperature of Resin]

Using a flow characteristic evaluation apparatus (trade name: FLOW TESTER CET-100C, manufactured by Shimadzu Corporation), 1 g of a specimen was heated at a rate of temperature increase of 6° C./min under a load of 20 kgf/cm$^2$ ($19.6\times10^5$ Pa) so that the specimen was pushed out a dye (a nozzle aperture of 1 mm and length of 1 mm) and a temperature at the time when a half amount of the specimen had flowed out of the dye was obtained as the softening temperature (Tm).

[Glass Transition Temperature of Resin]

Using a differential scanning calorimeter (trade name: DSC220, manufactured by Seiko Instruments & Electronics Ltd.), 1 g of a specimen was heated at a rate of temperature increase of 10° C./rain to measure a DEC curve in accordance with Japanese Industrial Standards (JIS) K7121-1987. An endothermic peak was measured in the obtained DSC curve.

If a maximum peak temperature which is a temperature of the peak at the highest temperature in the endothermic peaks observed is equal to or lower than the melting temperature by 20° C., it is obtained as a melting point, whereas if it is higher/lower than the melting temperature by 20° C. or more, it is caused by glass transition. A temperature at an intersection of a straight line that was elongated toward a low-temperature side from a base line on the high-temperature side of an endothermic peak corresponding to glass transition and a tangent line that was drawn so that a gradient thereof was maximum against a curve extending from a rising part to a top of the peak was obtained as the glass transition temperature (Tg).

When the binder resin contains an amorphous resin in addition to a crystalline polyester resin or the crystalline polyester resin contains an amorphous part, a temperature at an intersection of a straight line that was elongated toward a low-temperature side from a base line of a maximum peak temperature observed at a temperature lower than the highest temperature of the endothermic peak, or a temperature at an intersection between an elongated line of a base line at the highest temperature of the endothermic peak or lower and a tangential line showing maximum inclination to the top point of the peak from the initiation part of the peak was obtained as the glass transition temperature (Tg).

[Melting Point of Release Agent]

Using a differential scanning calorimeter (trade name: DSC220, manufactured by Seiko Instruments & Electronics Ltd.), 1 g of a specimen was heated from 20° C. to 200° C. at a rate of temperature increase of 10° C./min, and then an operation of rapidly cooling down from 200° C. to 20° C. was repeated twice, thus measuring a DSC curve. A temperature of an endothermic peak corresponding to the melting on the DSC curve measured at the second operation was obtained as the melting point of the release agent.

[Volume Average Particle Size and Coefficient of Variation of Toner Base Particles]

To 50 ml of an electrolyte (trade name: ISOTON-II, manufactured by Beckman Coulter, Inc.), 20 mg of a specimen and 1 ml of sodium alkyl ether sulfate were added, and the mixture was subjected to a dispersion treatment with an ultrasonic distributor (trade name: Desktop Two-Frequency Ultrasonic Cleaner VS-D100, manufactured by AS ONE Corporation) for three minutes at an ultrasonic frequency of 20 kHz, thereby preparing a specimen for measurement. The measurement sample was measured using a particle size distribution-measuring apparatus (trade name: MULTISIZER 3 manufactured by Beckman Coulter, Inc.) under the conditions that an aperture diameter was 100 μm and the number of particles for measurement was 50000 counts. A volume average particle size and a standard deviation in a volume particle size distribution were determined from the volume particle size distribution of the sample particles. The coefficient of variation (CV value, %) was calculated by the following expression:

$$\text{CV value}(\%)=(\text{Standard deviation in volume particle size distribution})/(\text{Volume average particle size})\times 100$$

[Crystallinity Index of Fine Resin Particle]

In the same manner as in the method for measuring the glass transition temperature, a temperature (Tc) corresponding to the highest temperature of the endothermic peak was measured. Using the softening temperature (Tm) measured as above and the temperature (Tc) corresponding to the highest temperature of the endothermic peak, a crystallinity index was calculated by the following expression:

$$\text{Crystalline Index}=Tm/Tc$$

[Volume Median Particle Size of Fine Resin Particles]

The volume median particle size of the fine resin particles was measured using a laser diffraction/scattering particle size distribution measurement apparatus (trade name: LA-920, manufactured by Horiba, Ltd.) as a 50%-frequency particle size (median diameter) on a volume basis.

Example 1

Toner Base Particle Producing Step S1

Polyester resin (trade name: TUFTON, manufactured by Kao Corporation, glass transition temperature of 60° C., softening temperature of 138° C.) 87 parts C. I. Pigment Blue 15:3 5 parts Release agent (trade name: CARNAUBA WAX, manufactured by To a Kasei Co., Ltd., melting point of 82° C.) 6 parts Charge control agent (trade name: BONTRON E84, manufactured by Orient Chemical Industries, Ltd.)

2 parts

After pre-mixing the raw materials described above by a HENSCHEL MIXER for 3 minutes, the mixture was melt-kneaded by a twin-screw extruder (trade name: PCM-30 manufactured by Ikegai Co., Ltd.) under a cylinder setting temperature of 110° C., a barrel rotational speed per minute of 300 rotations (300 rpm), and a raw material-feeding speed of 20 kg/hr. The melt-kneaded product was cooled down in a cooling belt, and then coarsely pulverized by a speed mill having a screen of diameter 2 mm. Then, the resultant was finely pulverized by a jet-type pulverizer (trade name: IDS-2, manufactured by Nippon Pneumatic Mfg. Co., Ltd.). Further, the resultant was classified by an ELBOW JET classifier (trade name, manufactured by Nittetsu Mining Co., Ltd.) to produce toner base particles A having a volume average particle size of 6.9 a coefficient of variation of 22, a softening temperature 116° C., and a glass transition temperature of 55° C.

[Fine Resin Particle Preparation Step S2]

<Production of Amorphous Polyester Fine Resin Particles PA1>

Polyoxypropylene(2,3)-2,2-bis(4-hydroxyphenyl)propane, ethylene glycol, terephthalic acid, isophthalic acid, and anhydrous trimellitic acid were allowed to undergo a reaction to obtain amorphous polyester resin 1 (a softening temperature of 122° C., the highest temperature of the endothermic peak of 64° C., a glass transition temperature of 64° C., and a crystallinity index 1.91).

The amorphous polyester resin 1 was dissolved in methyl ethyl ketone, and an aqueous anionic surfactant (sodium dodecyl sulfate) solution was added to the solution, and emulsified with a mechanic dispersing machine (trade name: CLEARMIX, manufactured by M Technique Co., Ltd.). The methyl ethyl ketone was evaporated under reduced pressure from the obtained emulsified product to obtain amorphous polyester fine resin particles PA1 (a volume median particle size of 0.2 μm).

<Production of Crystalline Polyester Fine Resin Particles PB1>

In a 5 liter-capacity four-neck flask equipped with a nitrogen inlet, a dehydrating tube, an agitator, and a thermocouple, were placed 300 g of 1,6-hexanediol, 812 g of fumaric acid, 4 g of dibutyltin oxide, and 1 g of hydroquinone. Then, they were reacted at 160° C. for 5 hours, and then reacted at an elevated temperature of 200° C. for 1 hour. Further, they were reacted at 8.3 kPa until they reached a desired crystallinity index to obtain crystalline polyester resin 1 (a softening temperature of 109° C., the highest temperature of the endothermic peak of 113° C., a glass transition temperature of 17° C., and a crystallinity index of 0.96).

The crystalline polyester resin 1 was dissolved in methyl ethyl ketone, and an aqueous anionic surfactant (sodium dodecyl sulfate) solution was added to the solution, and emulsified with a mechanic dispersing machine (trade name: CLEARMIX, manufactured by M Technique Co., Ltd.). The methyl ethyl ketone was evaporated under reduced pressure from the obtained emulsified product to obtain crystalline polyester fine resin particles PB1 (a volume median particle size of 0.15 μm).

[Coating Step S3]

<Preparation of Mixed Fine Resin Particles>

A dispersion solution in which the solid content of the content of the amorphous polyester fine resin particles PA1 was 7 parts by weight and a dispersion solution in which the solid content of the crystalline polyester fine resin particles PB1 was 3 parts by weight were prepared, and these emulsified dispersions were mixed to prepare mixed solutions of fine resin particles. Water was added thereto for the preparation to adjust the solid content concentration of the resin to 10% by weight.

The content of the crystalline polyester fine resin particles PB1 to the total solid contents in the fine resin particles mixed solution was 30% by weight. Further, the ratio of the volume median particle size of the crystalline polyester fine resin particles PB1 to that of the amorphous polyester fine resin particles PA1 was 75%. Further, 2 kg of the fine resin particles mixed solution was dried by freeze-drying to obtain mixed fine resin particles A.

<Production of Mixed Fine Resin Particle-Adhered Particles>

Into HENSCHEL MIXER 20B (manufactured by Mitsui Mining Co., Ltd.), 100 parts of the toner base particles A and 10 parts of the mixed fine resin particles A were put, and mixed at a peripheral speed of the stirring blade of 40 m/sec for 3 minutes to produce mixed fine resin particle-adhered particles.

<Preparation of Spray Solution>

Bis(p-methylbenzylidene)sorbitol as a crystal nucleating agent was put into ethanol, and pulverized with Planetary Ball Mill PM100 (manufactured by Retsch Co., Ltd.) until the volume 50% particle size of the crystal nucleating agent became 0.5 μm or less. Thereafter, the concentration was adjusted by the addition of ethanol until the solid content became 0.15 part by weight with respect to 10 g of the mixed fine resin particle-adhered particles when 20 g was sprayed, thereby obtaining spray solution A having a solid content concentration of 0.075% by weight.

The mixed fine resin particle-adhered particle were put into an apparatus in which a two-fluid nozzle had been installed in a Hybridization system (trade name: NHS-1 Model, manufactured by Nara Machinery Co., Ltd.) in accordance with the apparatus shown in FIG. 2, and allowed to stay at a rotation speed of 8000 rpm for 3 minutes, and thereafter, the spray solution A was sprayed.

For a liquid spraying unit, one in which a two-fluid nozzle and a liquid feeding pump (trade name: SP11-12, manufactured by FLOM Co., Ltd.) are connected so as to feed the liquid quantitatively can be used. The spraying speed of the spray solution A and the exhausting speed of the liquid gas can be observed using a commercially available gas detector (trade name: XP-3110, manufactured by New Cosmos Electric Co., Ltd.).

The temperature regulation jacket was provided over the entire surface of the powder flowing section and the wall surface of the stirring section. A temperature sensor was installed in the powder passage so that a temperature of the powder flowing section and the stirring section became 45° C. In the above-described apparatus, a peripheral speed in the outermost peripheral of the rotary stirring section was 100 m/sec in the step of adhering the mixed fine resin particle to the surfaces of the toner base particles. The peripheral speed was also 100 m/sec in the spraying step and the film-forming step. Moreover, an installation angle of the two-fluid nozzle was set so that an angle formed by the liquid spraying direction and the powder flowing direction (hereinafter referred to as "spray angle") is in parallel)(0°).

After spraying the spray solution A at a spraying speed of 0.5 g/min and an air flow of 5 L/min for 40 minutes, spraying of 20 g was performed to film-form the mixed fine resin particles A on the surfaces of the toner base particles A.

Then, spraying of the spray solution A was stopped, followed by stirring for 5 minutes, to obtain a capsule toner (a volume average particle size of 7.2 μm and a coefficient of variation of 25). In this case, an exhaust concentration of the gasified liquid exhausted through the through-hole and the gas exhausting section was stable at about 1.4% by volume. Moreover, the air flow into the apparatus was set to 10 L/min in total with the air flow from the two-fluid nozzle by adjusting the air flow from the rotary shaft section into the apparatus to 5 L/min.

To 100 parts of thus manufactured capsule toner, 2 parts of hydrophobic silica particles (manufactured by AEROSIL, a primary particle size of 12 nm, HMDS-treated) were added as an external additive, and mixed for 1 minute at a peripheral speed of the stirring blade of 30 m/sec to give a toner of Example 1.

Example 2

In the same manner as in Example 1 except that in the toner base particle producing step S1, the amount of the polyester resin used was 84 parts and 3 parts of bis(p-methylbenzylidene)sorbitol as a crystal nucleating agent was used, toner base particles B having a volume average particle size of 6.9 μm, a coefficient of variation of 24, a softening temperature of 118° C., and a glass transition temperature of 56° C. were produced. Further, a toner of Example 2 was obtained in the same manner as in Example 1 except that in the coating step S3, 100 parts of the toner base particles B were used instead of 100 parts of the toner base particles A, and ethanol was used instead of the spray solution A.

Example 3

Mixed fine resin particles B were obtained in the same manner as in Example 1 except that in the fine resin particle preparation step S2, a dispersion solution in which the solid content of the amorphous polyester fine resin particles PA1 was 6.7 parts by weight was used instead of the dispersion solution in which the solid content of the amorphous polyester fine resin particles PA1 was 7 parts by weight. Further, a toner of Example 3 was obtained in the same manner as in Example 1 except that in the coating step S3, 9.7 parts of the mixed fine resin particles B and 0.3 part of ethylene bisstearic acid amide were put instead of 10 parts of the mixed fine resin particles A, and ethanol was used instead of the spray solution A.

Example 4

In the same manner as in Example 1 except that in the toner base particle producing step S1, the amount of the polyester resin used was 82 parts and 5 parts of ethylene bisstearic acid amide as a crystal nucleating agent was used, toner base particles C having a volume average particle size of 6.9 μm, a coefficient of variation of 25, a softening temperature of 120° C., and a glass transition temperature of 57° C. were produced. Further, a toner of Example 4 was obtained in the same manner as in Example 1 except that in the coating step S3, 100 parts of the toner base particles C were used instead of 100 parts of the toner base particles A, and ethanol was used instead of the spray solution A.

Example 5

Mixed fine resin particles C were obtained in the same manner as in Example 1 except that in the fine resin particle preparation step S2, a dispersion solution in which the solid content of the amorphous polyester fine resin particles PA1 was 9 parts by weight and the solid content of the crystalline polyester fine resin particles PB1 was 1 part by weight was used instead of the dispersion solution in which the solid content of the amorphous polyester fine resin particles PA1 was 7 parts by weight and the solid content of the crystalline polyester fine resin particles PB1 was 3 parts by weight. Further, a toner of Example 5 was obtained in the same manner as in Example 1 except that in the coating step S3, parts of the mixed fine resin particles C was used instead of 10 parts of the mixed fine resin particles A.

Example 6

Mixed fine resin particles D were obtained in the same manner as in Example 1 except that in the fine resin particle preparation step S2, a dispersion solution in which the solid content of the amorphous polyester fine resin particles PA1 was 8.5 parts by weight and the solid content of the crystalline polyester fine resin particles PB1 was 1.5 parts by weight was used instead of the dispersion solution in which the solid content of the amorphous polyester fine resin particles PA1 was 7 parts by weight and the solid content of the crystalline polyester fine resin particles PB1 was 3 parts by weight. Further, a toner of Example 6 was obtained in the same manner as in Example 1 except that in the coating step S3, parts of the mixed fine resin particles D was used instead of 10 parts of the mixed fine resin particles A.

Example 7

Mixed fine resin particles E were obtained in the same manner as in Example 1 except that in the fine resin particle preparation step S2, a dispersion solution in which the solid content of the amorphous polyester fine resin particles PA1 was 5 parts by weight and the solid content of the crystalline polyester fine resin particles PB1 was 5 parts by weight was used instead of the dispersion solution in which the solid content of the amorphous polyester fine resin particles PA1 was 7 parts by weight and the solid content of the crystalline polyester fine resin particles PB1 was 3 parts by weight. Further, a toner of Example 7 was obtained in the same manner as in Example 1 except that in the coating step S3, parts of the mixed fine resin particles E was used instead of 10 parts of the mixed fine resin particles A.

Example 8

Mixed fine resin particles F were obtained in the same manner as in Example 1 except that in the fine resin particle preparation step S2, a dispersion solution in which the solid content of the amorphous polyester fine resin particles PA1 was 4 parts by weight and the solid content of the crystalline polyester fine resin particles PB1 was 6 parts by weight was used instead of the dispersion solution in which the solid content of the amorphous polyester fine resin particles PA1 was 7 parts by weight and the solid content of the crystalline polyester fine resin particles PB1 was 3 parts by weight.

A toner of Example 8 was obtained in the same manner as in Example 1 except that in the coating step S3, 10 parts of the mixed fine resin particles F was used instead of 10 parts of the mixed fine resin particles A.

Example 9

Production of Amorphous Styrene-Acrylate Copolymer Fine Resin Particles PA2

Styrene, acrylic acid, and butyl acrylate were polymerized to obtain amorphous styrene-acrylate copolymer fine resin particles PA2 (a volume median particle size of 0.18 μm, a softening temperature of 138° C., the highest temperature of the endothermic peak of 69° C., a glass transition temperature of 69° C., and a crystallinity index of 2.00). This was further freeze-dried to give dried powders.

Furthermore, mixed fine resin particles G were obtained in the same manner as in Example 1 except that in the fine resin particle preparation step S2, the amorphous styrene-acrylate copolymer fine resin particles PA2 were used instead of the amorphous polyester fine resin particles PA1. Further, a toner of Example 9 was obtained in the same manner as in Example 1 except that in the coating step S3, 10 parts of the mixed fine resin particles G was used instead of 10 parts of the mixed fine resin particles A.

Example 10

Production of Crystalline Polyester Fine Resin Particles PB2

In the same manner as for the production of the crystalline polyester fine resin particles PB1 except that the emulsification time was decreased, there was crystalline polyester fine resin particles PB2 (a volume median particle size of 0.18 μm, a softening temperature of 109° C., the highest temperature of the endothermic peak of 113° C., a glass transition temperature of 17° C., and a crystallinity index of 0.96).

Furthermore, mixed fine resin particles H were obtained in the same manner as in Example 9 except that in the fine resin particle preparation step S2, the crystalline polyester fine resin particles PB2 were used instead of the crystalline polyester fine resin particles PB1. Further, a toner of Example 10 was obtained in the same manner as in Example 1 except that in the coating step S3, 10 parts of the mixed fine resin particles H was used instead of 10 parts of the mixed fine resin particles A.

Example 11

Production of Crystalline Polyester Fine Resin Particles PB3

In the same manner as for the production of the crystalline polyester fine resin particles PB1 except that the emulsification time was decreased, there was obtained crystalline polyester fine resin particles PB2 (a volume median particle size of 0.22 μm, a softening temperature of 109° C., the highest temperature of the endothermic peak of 113° C., a glass transition temperature of 17° C., and a crystallinity index of 0.96). Further, mixed fine resin particles I were obtained in the same manner as in Example 9 except that in the fine resin particle preparation step S2, the crystalline polyester fine resin particles PB3 were used instead of the crystalline polyester fine resin particles PB1. Further, a toner of Example 11 was obtained in the same manner as in Example 1 except that in the coating step S3, 10 parts of the mixed fine resin particles I was used instead of 10 parts of the mixed fine resin particles A.

Example 12

Mixed fine resin particles J were obtained in the same manner as in Example 11 except that in the fine resin particle preparation step S2, a dispersion solution in which the solid content of the amorphous styrene-acrylate copolymer fine resin particles PA2 was 6.7 parts by weight was used instead of the dispersion solution in which the solid content of the amorphous styrene-acrylate copolymer fine resin particles PA2 was 7 parts by weight. Further, a toner of Example 12 was obtained in the same manner as in Example 11 except that in the coating step S3, 9.7 parts of mixed fine resin particles J and 0.3 part of bis(p-methylbenzylidene)sorbitol were put instead of 10 parts of the mixed fine resin particles I and ethanol was used instead of the spray solution A.

Comparative Example 1

A toner of Comparative Example 1 was obtained in the same manner as in Example 1 except that in the coating step S3, ethanol was used instead of the spray solution A.

Comparative Example 2

A toner of Comparative Example 2 was obtained in the same manner as in Example 1 except that in the fine resin particle preparation step S2, the mixed fine resin particles were not prepared, 10 parts of the amorphous polyester fine resin particles PA1 were used instead of 10 parts of the mixed fine resin particles A in the coating step S3, and ethanol was used instead of the spray solution A.

<Production of Two-Component Developer>

Each of the toners of Examples 1 to 12 and Comparative Examples 1 and 2, and ferrite core carriers having a volume average particle size of 60 μm were mixed to a toner concentration of 7%, thereby producing a two-component developer.

The toners of Examples 1 to 12 and Comparative Examples 1 and 2 were evaluated by the following manners.

[Preservation Stability]

In a plastic container, 20 g of the toner was sealed and left for 48 hours at 50° C., and then the toner was taken out and screened out through a 230-mesh sieve. The weight of the toner remaining on the sieve was measured and the ratio of the weight to the total weight of the toners was determined (the remaining amount of the toner, %) and evaluated based on the following criteria. The lower value indicates that the toner is not blocked and its preservation property is good.

Good (Favorable): The remaining amount of the toner is 0% or more and 15% or less.

Not bad (Slightly poor): The remaining amount of the toner is more than 15% and 30% or less Poor (No good): The remaining amount of the toner is more than 30%.

[Low-Temperature Fixability]

Two-component developers were each charged in an image forming apparatus (color multifunctional peripheral MX4501, manufactured by Sharp Corporation) to perform development, and adjusted to a toner adhering amount on paper of 0.4 mg/cm$^2$. The surface temperature of the heating roller was elevated from 130° C. to 220° C. by 5° C. to form an image. The lower limit temperature at which a low-temperature off-set does not occur was taken as a lowest fixing temperature, and evaluated based on the following criteria.

Good (Favorable): The difference of the lowest fixing temperature is 155° C. or lower.

Not bad (Slightly poor): The difference of the lowest fixing temperature is higher than 155° C. and lower than 170° C.

Poor (No good): The difference of the lowest fixing temperature is 170° C. or higher.

The evaluation results of the toners of Examples 1 to 12 and Comparative Examples 1 and 2 are shown in Table 1.

TABLE 1

| | Toner base particles | Mixed fine resin particles (10 parts by weight) | | | Spray solution | Evaluation results | |
|---|---|---|---|---|---|---|---|
| | (100 parts by weight) Crystal nucleating agent (parts by weight) | Amorphous fine resin particles (parts by weight) | Crystalline polyester fine resin particles (parts by weight) | Crystal nucleating agent (parts by weight) | (ethanol 20 parts by weight) Crystal nucleating agent (parts by weight) | Preservation stability (amount of remaining toner) | Low-temperature fixability (lowest fixing temperature) |
| Example 1 | None | PA1 (7) | PB1 (3) | None | Bis(p-methylbenzylidene)sorbitol (0.15) | Good (0%) | Good (150° C.) |

TABLE 1-continued

| | Toner base particles | Mixed fine resin particles (10 parts by weight) | | | Spray solution | Evaluation results | |
|---|---|---|---|---|---|---|---|
| | (100 parts by weight) Crystal nucleating agent (parts by weight) | Amorphous fine resin particles (parts by weight) | Crystalline polyester fine resin particles (parts by weight) | Crystal nucleating agent (parts by weight) | (ethanol 20 parts by weight) Crystal nucleating agent (parts by weight) | Preservation stability (amount of remaining toner) | Low-temperature fixability (lowest fixing temperature) |
| Example 2 | Bis(p-methyl-benzyl-idene)sorbitol (3) | PA1 (7) | PB1 (3) | None | None | Good (6%) | Good (155° C.) |
| Example 3 | None | PA1 (6.7) | PB1 (3) | Ethylene bisstearic acid amide (0.3) | None | Good (3%) | Good (150° C.) |
| Example 4 | Ethylene bisstearic acid amide (5) | PA1 (7) | PB1 (3) | None | None | Good (9%) | Good (155° C.) |
| Example 5 | None | PA1 (9) | PB1 (1) | None | Bis(p-methylbenzylidene)sorbitol (0.15) | Good (0%) | Good (155° C.) |
| Example 6 | None | PA1 (8.5) | PB1 (1.5) | None | Bis(p-methylbenzylidene)sorbitol (0.15) | Good (1%) | Good (155° C.) |
| Example 7 | None | PA1 (5) | PB1 (5) | None | Bis(p-methylbenzylidene)sorbitol (0.15) | Good (13%) | Good (145° C.) |
| Example 8 | None | PA1 (4) | PB1 (6) | None | Bis(p-methylbenzylidene)sorbitol (0.15) | Not bad (21%) | Good (140° C.) |
| Example 9 | None | PA2 (7) | PB1 (3) | None | Bis(p-methylbenzylidene)sorbitol (0.15) | Good (6%) | Good (155° C.) |
| Example 10 | None | PA2 (7) | PB2 (3) | None | Bis(p-methylbenzylidene)sorbitol (0.15) | Good (7%) | Good (155° C.) |
| Example 11 | None | PA2 (7) | PB3 (3) | None | Bis(p-methylbenzylidene)sorbitol (0.15) | Good (8%) | Not bad (160° C.) |
| Example 12 | None | PA2 (6.7) | PB3 (3) | Bis(p-methyl-benzyl-idene)sorbitol (0.3) | None | Not bad (18%) | Not bad (160° C.) |
| Comparative Example. 1 | None | PA1 (7) | PB1 (3) | None | None | Poor (39%) | Good (150° C.) |
| Comparative Example. 2 | None | PA1 (10) | None | None | None | Good (0%) | Poor (170° C.) |

As seen from the results in Table 1, the toners of Examples 1 to 12 had good preservation stability and good low-temperature fixability, as compared with the toners of Comparative Examples 1 and 2. It is thought that since the toner of Comparative Example 1 does not contain the crystal nucleating agent, the preservation stability becomes poor, and since the toner of Comparative Example 2 does not contain the crystalline polyester, the low-temperature fixability becomes poor.

In comparison of the preservation stability and the low-temperature fixability for the toners of Examples 1 to 4, the toner of Example 1 was most excellent and then the toner of Example 3 was excellent. From these results, it was found that regarding the order of addition of the crystal nucleating agent for exhibition of the effect, incorporation of the crystal nucleating agent in the spray solution is most effective, and incorporation of the crystal nucleating agent in the mixed fine resin particles is rather more effective than in the toner base particles. Further, in comparison of Examples 2 and 4, by using a sorbitol-based compound as the crystal nucleating agent, excellent results can be obtained even when the crystal nucleating agent is contained in the toner base particles. This is based on the sorbitol-based compound having higher solubility in ethanol than fatty acid amide.

Furthermore, in comparison of the preservation stability and the low-temperature fixability for Examples 1, and 5 to 8, the toner of Example 8 had slightly poor preservation stability. This is thought to be caused by a high ratio of the crystalline polyester fine resin particles in the mixed fine resin particles.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for manufacturing a capsule toner, comprising:

a mixed fine resin particle adhering step of adhering mixed fine resin particles including crystalline polyester fine resin particles and amorphous fine resin particles to surfaces of toner base particles to form mixed fine resin particle-adhered particles;

a spraying step of spraying a mixed solution of a liquid for plasticizing the toner base particles and the mixed fine resin particles and a crystal nucleating agent, while fluidizing the mixed fine resin particles-adhered particles; and a film-forming step of making a film of the mixed fine resin particles by impact force so that the film is a resin coating layer on the surfaces of the toner base particles.

2. The method of claim 1, wherein the crystal nucleating agent is a sorbitol-based compound.

3. A method for manufacturing a capsule toner, comprising:

a mixed fine resin particle adhering step of adhering mixed fine resin particles including crystalline polyester fine resin particles, amorphous fine resin particles, and a crystal nucleating agent to surfaces of toner base particles to form mixed fine resin particle-adhered particles;

a spraying step of spraying a liquid for plasticizing the toner base particles and the mixed fine resin particles, while fluidizing the mixed fine resin particle-adhered particles; and a film-forming step of making a film of the mixed fine resin particles by impact force so that the film is a resin coating layer on the surfaces of the toner base particles.

4. The method of claim 3, wherein the crystal nucleating agent is a fatty acid amide or a sorbitol-based compound.

* * * * *